US005712810A

United States Patent [19]

Kimura

[11] Patent Number: 5,712,810

[45] Date of Patent: Jan. 27, 1998

[54] ANALOG MULTIPLIER AND MULTIPLIER CORE CIRCUIT USED THEREFOR

[75] Inventor: Katsuji Kimura, Tokyo, Japan

[73] Assignee: NEC Corporation, Tokyo, Japan

[21] Appl. No.: 489,639

[22] Filed: Jun. 12, 1995

[30] Foreign Application Priority Data

Jun. 13, 1994 [JP] Japan ..... 6-130468

[51] Int. Cl.[6] ..... G06G 7/16

[52] U.S. Cl. ..... 364/841; 327/359

[58] Field of Search ..... 364/841; 327/349, 327/359

[56] References Cited

U.S. PATENT DOCUMENTS

| | | | |
|---|---|---|---|
| 5,107,150 | 4/1992 | Kimura | 327/349 |
| 5,187,682 | 2/1993 | Kimura | 364/841 |
| 5,444,648 | 8/1995 | Kimura | 364/841 |

FOREIGN PATENT DOCUMENTS 0 603 829 6/1994 European Pat. Off. .

OTHER PUBLICATIONS

K. Bult et al., "A CMOS Four-Quadrant Analog Multiplier", IEEE Journal of Solid-State Circuits, Jun. 1986, vol. SC-21, No. 3, pp. 430-435.

Z. Wang, "Novel Linearisation Technique for Implementing Large-Signal MOS Tunable Transconductor", Electronic Letters, Jan. 18, 1990, vol. 26, No. 2, pp. 138-139.

P. Wu et al., "Tunable Operational Transconductance Amplifier with Extremely High Linearity Over Very Large Input Range", Electronic Letters, Jul. 4.

*Primary Examiner*—Tan V. Mai

*Attorney, Agent, or Firm*—Young & Thompson

[57] ABSTRACT

A multiplier core circuit having a novel circuit configuration, which is preferable for LSI. The circuit contains a quadritail circuit formed of first, second, third and fourth transistors whose emitters or sources are coupled together. Collectors or drains of the first and fourth transistors are coupled together and collectors or drains of the second and third transistors are coupled together. A sum of first and second input signals to be multiplied is applied to a base or gate of the first transistor with regard to a reference point. The first input signal is applied to a base or gate of the second transistor with regard to said reference point. The second input signal is applied to a base or gate of the third transistor with regard to the reference point. Neither the first input signal nor the second input signal are applied to a base or gate of the fourth transistor. An output signal showing multiplication result of the first and second input signals is differentially derived between the collectors or drains of the first and fourth transistors and the collectors or drains of the second and third transistors.

39 Claims, 23 Drawing Sheets

ANALOG MULTIPLIER AND MULTIPLIER CORE CIRCUIT USED THEREFOR

BACKGROUND OF THE INVENTION

The present invention relates to an analog multiplier and a multiplier core circuit used for the multiplier, and more particularly, to an analog multiplier that multiplies two analog signals and a multiplier core circuit containing four bipolar transistors or Field-Effect Transistors (FETs), which is preferably realized on a semiconductor integrated circuit device.

An analog multiplier constitutes a functional circuit block essential for analog signal applications. Recently, semiconductor integrated circuits have been made finer and finer and as a result, their supply voltages have been decreasing from 5 V to 3.3 V or less. Under such circumstances, the need has arisen for circuits that can operate at a low voltage such as 3 V or less. In the present invention, the multiplier also needs to have linear input voltage ranges as wide as possible.

Also, the Complementary Metal-Oxide-Semiconductor (CMOS) technology has been recognized as the optimum process technology for Large Scale Integration (LSI), so that analog multipliers and multiplier core circuits that can be realized with LSI using CMOS technology have been required.

FIG. 1 shows a first example of a conventional MOS multiplier core circuit which has a typical or basic configuration and floating inputs. With this conventional multiplier, a quadritail circuit is formed of four p-channel MOSFETs M81, M82, M83 and M84 and a constant current source (current: $I_0$) for driving the quadritail circuit. The MOSFETs M81, M82, M83 and M84 have the same transconductance parameter β.

Sources of the MOSFETs M81, M82, M83 and M84 are coupled together. The constant current source is connected between the coupled sources and the ground. Drains of the MOSFETs M81 and M84 are coupled together. Drains of the MOSFETs M82 and M83 are coupled together.

Gates of the MOSFETs M81, M82, M83 and M84 receive four input voltages $V_1$, $V_2$, $V_3$, and $V_4$, respectively. An output current $I_L$ is derived from the coupled drains of the MOSFETs M81 and M84. Another output current $I_R$ is derived from the coupled drains of the MOSFETs M82 and M83. A differential output current ΔI of the multiplier core circuit is defined as $\Delta I=I_L-I_R$.

FIG. 2 shows a second example of a conventional MOS multiplier core circuit which has a source-grounded configuration and floating inputs. With the conventional multiplier core circuit of FIG. 2, there are four p-channel MOSFETs M91, M92, M93 and M94 whose sources are grounded. The MOSFETs M91, M92, M93 and M94 have the same transconductance parameter β.

Drains of the MOSFETs M91 and M94 are coupled together. Drains of the MOSFETs M92 and M93 are coupled together.

Similar to the first example of FIG. 1, gates of the MOSFETs M91, M92, M93 and M94 receive four input voltages $V_1$, $V_2$, $V_3$, and $V_4$, respectively. An output current $I_L$ is derived from the coupled drains of the MOSFETs M91 and M94. Another output current $I_R$ is derived from the coupled drains of the MOSFETs M92 and M93. A differential output current ΔI of the multiplier core circuit is defined as $\Delta I=I_L-I_R$.

With the conventional multiplier core circuits of FIGS. 1 and 2, the linear behavior is typically defined by the following algebraic equation (1) containing two parameters a and b.

$$(a+b)^2-(a-b)^2=4ab \tag{1}$$

It is seen from the equation (1) that the linear function is defined by the difference between the square of (a+b) and the square of (a−b).

The technique utilizing the equation (1) is well known as the "quarter-square technique", in which various multiplier core circuits made of two squarers, each of which is formed of two MOSFETs. As is known, the MOSFET has the square-law characteristic.

If a surplus or extra parameter c is additionally used, the linear behavior can be defined by the following algebraic equations (2), (3) or (4)

It is seen from the equations (2), (3) and (4) that the linear function may be defined by four terms each containing the square of at least one of the three parameters a, b and c.

$$(a+b+c)^2-(a-b+c)^2+(a+b-c)^2-(a-b-c)^2=8ab \tag{2}$$

$$(a+c)^2-(a-c)^2+(a+b-c)^2-(a-b+c)^2=4ab \tag{3}$$

$$(a+b+c)^2-(a-c)^2+(-c)^2-(b-c)^2=2ab \tag{4}$$

If b is replaced by (b/2) and c is replaced by [c+(b/2)] in the equation (2), the equation (2) becomes the same as the equation (3). If a is replaced by (2a) and c is replaced by (c−a) in the equation (4), the equation (4) becomes the same as the equation (3).

The equations (2), (3) and (4) show that the linear function can be realized by the combination of four MOSFETs.

In the case of the MOSFETs operating in the saturation region, assuming that the channel-length modulation and the body effect can be ignored, the drain current $I_{Di}$ of the i-th MOSFET is expressed by the following equations (5*a*) and (5*b*), where β is the transconductance parameter, $V_{GSi}$ are the gate-to-source voltages of the i-th MOSFETs, and $V_{TH}$ is the threshold voltage thereof.

$$I_{Di}=\beta(V_{GSi}-V_{TH})^2(V_{GSi}\geqq V_{TH}) \tag{5a}$$

$$I_{Di}=0\ (V_{GSi\leqq VTH}) \tag{5b}$$

The transconductance parameter β is expressed as $$\beta=(1/2)(W/L)\mu C_{ox},$$

where μ is the effective surface carrier mobility, $C_{ox}$ is a gate-oxide capacity per unit area, and W and L are a gate width and a gate length of each MOSFET, respectively.

Therefore, the parameter c includes the threshold voltage $V_{TH}$. However, if the input voltages to the respective MOSFETs are set to satisfy the equations (2), (3) or (4), the threshold voltage $V_{TH}$ can be deleted. In other words, if the input voltages $V_1$, $V_2$, $V_3$ and $V_4$ to the input ends or gates of the respective MOSFETs M81, M82, M83 and M84 (or M91, M92, M93 and M94) are set to satisfy the equations (2), (3) or (4), and the output ends or coupled drains of the MOSFETs and M84 (or M91 and M94) and those of the MOSFETs M82 and M83 (or M92 and M93) are cross-coupled, the relationship between the input voltages $V_1$, $V_2$, $V_3$ and $V_4$ and the differential output current ΔI can be linearized.

In the input voltage range where none of the MOSFETs M81, M82, M83 and M84 (or M91, M92, M93 and M94) are cut off, each MOSFET has the square-law characteristic as shown in the equation (5a). Therefore, the four input voltages of the first and second examples of FIGS. 1 and 2 satisfy the equations (2), (3) or (4).

The differential output current ΔI of the multiplier core circuit of FIG. 1 is expressed as the following equation (6).

$$\frac{\Delta I}{\beta} = (V_1 + V_R - V_S - V_{TH})^2 - (V_2 + V_R - V_S - V_{TH})^2 - (V_3 + V_R - V_S - V_{TH})^2 + (V_4 + V_R - V_S - V_{TH})^2 = V_1^2 - V_2^2 - V_3^2 + V_4^2 + 2c(V_1 - V_2 - V_3 + V_4) \quad (6)$$

In the equation (6), $c=V_R-V_s-V_{TH}$, where $V_R$ is the direct current (dc) voltage of the input signals $V_1$, $V_2$, $V_3$ and $V_4$, and $V_S$ is the common source voltage. With the conventional multiplier core circuit of FIG. 2, $V_S=0$.

Since the quadritail circuit in the conventional multiplier core circuit of FIG. 1 is driven by the common tail current, the following equation (7) needs to be satisfied additionally, where $I_{D1}$, $I_{D2}$, $I_{D3}$ and $I_{D4}$ are the drain currents of the respective MOSFETS M81, M82, M83 and M84.

$$I_{D1}+I_{D2}+I_{D3}+I_{D4}=I_0 \quad (7)$$

When the input voltages $V_1$, $V_2$, $V_3$ and $V_4$ are set to satisfy the above equation (4), the following equation (8) is established.

$$V_1-V_2-V_3+V_4=0 \quad (8)$$

If the equation (8) is substituted into the equation (6), the differential output current $\Delta I$ is expressed as the following equation (9).

$$\frac{\Delta I}{\beta} = V_1^2 - V_2^2 - V_3^2 + V_4^2 = (V_1 - V_2)(V_1 + V_2 - V_3 - V_4) \quad (9)$$

It is seen from the equation (9) that the input voltages $V_1$, $V_2$, $V_3$and $V_4$ needs to be adaptively decided in order to linearize the differential output current $\Delta I$.

Conventionally, some multiplier core circuits in which the input voltages $V_1$, $V_2$, $V_3$ and $V_4$are adaptively set to linearize the differential output current $\Delta I$ have been developed. Bult and Wallinga disclosed such a multiplier core circuit in IEEE Journal of Solid-State Circuits, Vol. SC-21, No. 3, pp. 430–435, June 1986. Wang redisclosed a multiplier core circuit in IEE Electronics Letters, 18th Jan. 1990, Vol. 26, No. 9, which was originally discovered by Bult. Wu and Schaumann disclosed a multiplier core circuit in IEEE Electron Letters, 4th July, 1991, Vol. 27, No. 14.

FIGS. 3 and 4 show third and fourth examples (1st type) of the conventional MOS multiplier core circuits, both of which were developed by Bult and Wallinga. FIG. 5 shows a fifth example (2nd type) of the conventional MOS multiplier core circuits, which was redeveloped by Wang. FIG. 6 shows a sixth example (2nd type) of the conventional MOS multiplier core circuits, which was developed by Wu and Schaumann.

The conventional multiplier core circuit of FIG. 3 includes a quadritail circuit formed of four p-channel MOSFETs M101, M102, M103 and M104 and a constant current source (current: $I_0$) for driving the quadritail circuit. The MOSFETs M101, M102, M103 and M104 have the same transconductance parameter $\beta$.

Sources of the MOSFETs M101, M102, M103 and M104 are coupled together. The constant current source is connected to the coupled sources and the ground, respectively. Drains of the MOSFETs M101 and M104 are coupled together. Drains of the MOSFETs M102 and M103 are coupled together.

A gate of the MOSFET 101 is applied with an input voltage $(½)(V_x+V_y)$ with regard to a reference point. A gate of the MOSFET M102 receives an input voltage $(½)(V_x-V_y)$ with regard to the reference point. A gate of the MOSFET M103 is applied with an input voltage $(-½)(V_x-V_y)$ with regard to the reference point. A gate of the MOSFET M104 is applied with an input voltage $(-½)(V_x+V_y)$ with regard to the reference point.

A voltage source (voltage: $V_R$) is provided between the reference point and the ground.

An output current $I_L$ is derived from the coupled drains of the MOSFETs M101 and M104. Another output current $I_R$ is derived from the coupled drains of the MOSFETs M102 and M103.

In the conventional multiplier core circuit of FIG. 4, there are four p-channel MOSFETs M111, M112, M113 and M114 whose sources are grounded. The MOSFETs M111, M112, M113 and M114 have the same transconductance parameter $\beta$.

Drains of the MOSFETs M111 and M114 are coupled together. Drains of the MOSFETs M112 and M113 are coupled together.

A gate of the MOSFET M111 receives an input voltage $(½)(V_x+V_y)$ with regard to a reference point. A gate of the MOSFET M112 is applied with an input voltage $(½)(V_x-V_y)$ with regard to the reference point. A gate of the MOSFET M113 is applied with an input voltage $(-½)(V_x-V_y)$ with regard to the reference point. A gate of the MOSFET M114 is applied with an input voltage $(-½)(V_x+V_y)$ with regard to the reference point.

A voltage source (voltage: $V_R$) is provided between the reference point and the ground.

An output current $I_L$ is derived from the coupled drains of the MOSFETs M111 and M114. Another output current $I_R$ is derived from the coupled drains of the MOSFETs M112 and M113.

With the conventional multiplier core circuits (1st type) of FIGS. 3 and 4, since the combination of the input voltages ($V_1$, $V_2$, $V_3$, $V_4$) is in the form of (a+b, a–b, –a+b,–a–b), the input voltages $V_1$, $V_2$, $V_3$and $V_4$ satisfy the above equation (2). In this case, $V_1-V_2=2b$ and $V_1+V_2-V_3-V_4=4a$ are established from the equation (9), because $V_1+V_2=-V_3-V_4=2a$. As a result, $(\Delta I/\beta)=8ab$.

Next, the conventional multiplier core circuit of FIG. 5 is described. A quadritail circuit is formed of four p-channel MOSFETs M121, M122, M123 and M124 and a constant current source (current: $I_0$) for driving the quadritail circuit. The MOSFETs M121, M122, M123 and M124 have the same transconductance parameter $\beta$.

Sources of the MOSFETs M121, M122, M123 and M124 are coupled together. The constant current source is connected to the coupled sources and the ground, respectively. Drains of the MOSFETs M121 and M124 are coupled together. Drains of the MOSFETs M122 and M123 are coupled together.

A gate of the MOSFET M121 receives an input voltage $(½)V_x$ with regard to a reference point. A gate of the MOSFET M122 receives an input voltage $(-½)V_x$ with regard to the reference point. A gate of the MOSFET M123 receives an input voltage $[(½)V_x-V_y]$ with regard to the reference point. A gate of the MOSFET M124 receives an input voltage $[(-½)V_x-V_y]$ with regard to the reference point.

A voltage source (voltage: $V_R$) is provided between the reference point and the ground.

An output current $I_L$ is derived from the coupled drains of the MOSFETs M121 and M124. Another output current $I_R$ is derived from the coupled drains of the MOSFETs M122 and M123.

Further, in the conventional multiplier core circuit of FIG. 6, there are four p-channel MOSFETs M131, M132, M133 and M134 whose sources are grounded. The MOSFETs M131, M132, M133 and M134 have the same transconductance parameter β.

Drains of the MOSFETs M131 and M134 are coupled together. Drains of the MOSFETs M132 and M133 are coupled together.

A gate of the MOSFET M131 receives an input voltage $(½)V_x$ with regard to a reference point. A gate of the MOSFET M132 receives an input voltage $(-½)V_x$ with regard to the reference point. A gate of the MOSFET M133 receives an input voltage $[(½)V_x-V_y]$ with regard to the reference point. A gate of the MOSFET M134 receives an input voltage $[(-½)V_x-V_y]$ with regard to the reference point.

A voltage source (voltage: $V_R$) is provided between the reference point and the ground.

An output current $I_L$ is derived from the coupled drains of the MOSFETs M131 and M134. Another output current $I_R$ is derived from the coupled drains of the MOSFETs M132 and M133.

With the conventional multiplier core circuits (2nd type) of FIGS. 5 and 6, since the combination of the input voltages ($V_1$, $V_2$, $V_3$, $V_4$) is in the form of (a,−a, a−b, −a−b), the input voltages $V_1$, $V_2$, $V_3$and $V_4$satisfy the above equation (3). In this case, $V_1-V_2=2a$ and $V_1+V_2-V_3-V_4=2b$ are established from the equation (9), because $V_1+V_2=0$ and $-V_3-V_4=2b$. As a result, $(\Delta I/\beta)=4ab$.

As described previously, if b is replaced by (b/2) and c is replaced by [c+(b/2)] in the equation (2), the equation (2) becomes the same as the equation (3). If a is replaced by (2a) and c is replaced by (c−a) in the equation (4), the equation (4) becomes the same as the equation (3). If such the replacements are performed, $(\Delta I/\beta)$ for the third to sixth examples of the conventional multiplier core circuits of FIGS. 3, 4, 5 and 6 takes the same value of 2b, i.e., $(\Delta I/\beta)=2ab$.

This means that the above conventional multiplier core circuits of FIGS. 3, 4, 5 and 6 each provides the linear multiplier characteristic.

Next, conventional bipolar multiplier core circuits are described.

FIG. 7 shows a first example of a conventional bipolar multiplier core circuit, which has a typical or basic configuration and floating inputs. With this conventional multiplier of FIG. 7, a quadritail circuit is formed of four npn-type transistors Q71, Q72, Q73 and Q74 and a constant current source (current: $I_O$) for driving the quadritail circuit. The transistors Q71, Q72, Q73 and Q74 have the same emitter area.

Emitters of the transistors Q71, Q72, Q73 and Q74 are coupled together. The constant current source is connected between the coupled emitters and the ground. Collectors of the transistors Q71 and Q74 are coupled together. Collectors of the transistors Q72 and Q73 are coupled together.

Bases of the transistors Q71, Q72, Q73 and Q74 receive four input voltages $V_1$, $V_2$, $V_3$ and $V_4$, respectively. An output current $I_L$ is derived from the coupled collectors of the transistors Q71 and Q74. Another output current $I_R$ is derived from the coupled collectors of the transistors Q72 and Q73. A differential output current $\Delta I=I_L-I_R$.

In the multiplier core circuit of FIG. 7, if the relationship between the collector current and the base-emitter voltage varies dependent on the exponential-law characteristic, the collector current $I_{Ci}$ of the i-th transistor is expressed as the following equation (10), where $I_S$ is the saturation current, $V_{BEi}$ is the base-emitter voltage of each transistor i, and $V_T$ is the thermal voltage.

$$I_{Ci}=I_S\left\{\exp\left(\frac{V_{BEi}}{V_T}\right)-1\right\} \tag{10}$$

The thermal voltage $V_T$ is expressed as $V_T=kT/q$ where k is Boltzmann's constant, T is absolute temperature in degrees Kelvin and q is the charge of an electron.

In the equation (10), if $V_{BE}$ is about 600 mV, the exponential term "exp $(V_{BE}/V_T)$" has a value in the order of $e^{10}$, and therefore, the term "−1" can be neglected. As a result, the equation (10) can be approximated as the following equation (11).

$$I_{Ci}=I_S\exp\left(\frac{V_{BEi}}{V_T}\right) \tag{11}$$

Then, assuming that all the transistors Q71, Q72, Q73 and Q74 have matching characteristics, the collector currents of the transistors Q71, Q72, Q73 and Q74 driven by the tail current $I_O$are expressed as the following equations (12), (13), (14) and (15), respectively, where $V_R$ is the dc voltage of the input signals and $V_E$is the common emitter voltage.

$$I_{C1}=I_S\exp\left(\frac{V_1+V_R-V_E}{V_T}\right) \tag{12}$$

$$I_{C2}=I_S\exp\left(\frac{V_2+V_R-V_E}{V_T}\right) \tag{13}$$

$$I_{C3}=I_S\exp\left(\frac{V_3+V_R-V_E}{V_T}\right) \tag{14}$$

$$I_{C4}=I_S\exp\left(\frac{V_4+V_R-V_E}{V_T}\right) \tag{15}$$

Since the quadritail circuit in FIG. 7 is driven by the common tail current $I_O$, the following equation (16) needs to be satisfied additionally, where $\alpha_F$ is the dc common-base current gain factor.

$$I_{C1}+I_{C2}+I_{C3}+I_{C4}=\alpha_F I_O \tag{16}$$

Solving the equations (12), (13), (14), (15) and (16) provides the following equation (17).

$$I_S\exp\left(\frac{V_R-V_E}{V_T}\right)=\frac{\alpha_F I_O}{\left\{\exp\left(\frac{V_1}{V_T}\right)+\exp\left(\frac{V_2}{V_T}\right)+\exp\left(\frac{V_3}{V_T}\right)+\exp\left(\frac{V_4}{V_T}\right)\right\}} \tag{17}$$

The differential output current ΔI is expressed as the following equation (18).

$$\Delta I=\frac{\alpha_F I_O\left\{\exp\left(\frac{V_1}{V_T}\right)-\exp\left(\frac{V_2}{V_T}\right)-\exp\left(\frac{V_3}{V_T}\right)+\exp\left(\frac{V_4}{V_T}\right)\right\}}{\left\{\exp\left(\frac{V_1}{V_T}\right)+\exp\left(\frac{V_2}{V_T}\right)+\exp\left(\frac{V_3}{V_T}\right)+\exp\left(\frac{V_4}{V_T}\right)\right\}} \tag{18}$$

It is seen from the equation (18) that the input voltages $V_1$, $V_2$, $V_3$and $V_4$need to be adaptively decided in order to multiply two of the input voltages $V_1$, $V_2$, $V_a$and $V_4$to produce the differential output current ΔI.

FIG. 8 shows a second example of a conventional bipolar multiplier core circuit in which the input voltages $V_1$, $V_2$, $V_3$ and $V_4$ are adaptively set to linearize the differential output current ΔI. This circuit is obtained by replacing the MOSFETs by bipolar transistors in the circuit of Bult and Wallinga shown in FIG. 3.

In FIG. 8, a quadritail circuit is formed of four npn-type transistors Q81, Q82, Q83 and Q84 and a constant current source (current: $I_0$) for driving the quadritail circuit. The transistors Q81, Q82, Q83 and Q84 have the same emitter area.

Emitters of the transistors Q81, Q82, Q83 and Q84 are coupled together. The constant current source is connected to the coupled emitters and the ground, respectively. Collectors of the transistors Q81 and Q84 are coupled together. Collectors of the transistors Q82 and Q83 are coupled together.

A base of the transistor Q81 receives an input voltage $(½)(v_x+V_y)$ with regard to a reference point. A base of the transistor Q82 receives an input voltage $(½)(v_x-V_y)$ with regard to the reference point. A base of the transistor Q83 receives an input voltage $(-½)(V_x-V_y)$ with regard to the reference point. A base of the transistor Q84 receives an input voltage $(-½)(V_x+V_y)$ with regard to the reference point.

An output current $I_L$ is derived from the coupled collectors of the transistors Q81 and Q84. Another output current $I_R$ is derived from the coupled collectors of the transistors Q82 and Q83. A differential output current ΔI of the multiplier core circuit is defined as $\Delta I=I_L-I_R$.

In the conventional multiplier core circuit of FIG. 8, $V_1=(½)(V_x+V_y)$, $V_2=(½)(V_x-V_y)$, $V_3=(-½)(V_x-V_y)$, and $V_4=(-½)(V_x-V_y)$. Therefore, the differential output current ΔI is expressed as the following equation (19) from the equation (18).

$$\Delta I = \alpha_F I_0 \tanh\left(\frac{V_x}{2V_T}\right)\tanh\left(\frac{V_y}{2V_T}\right) \tag{19}$$

FIG. 9 shows a third example of the conventional bipolar multiplier core circuits in which the input voltages $V_1$, $V_2$, $V_3$, and $V_4$ are adaptively set. This circuit is obtained by replacing the MOSFETs by bipolar transistors in the circuit of Wang shown in FIG. 5.

In FIG. 9, a quadritail circuit is formed of four npn-type transistors Q91, Q92, Q93 and Q94 and a constant current source (current: $I_0$) for driving the quadritail circuit. The transistors Q91, Q92, Q93 and Q94 have the same emitter area.

Emitters of the transistors Q91, Q92, Q93 and Q94 are coupled together. The constant current source is connected to the coupled emitters and the ground, respectively. Collectors of the transistors Q91 and Q94 are coupled together. Collectors of the transistors Q92 and Q93 are coupled together.

A base of the transistor Q91 receives an input voltage $(½)V_x$ with regard to a reference point. A base of the transistor Q92 receives an input voltage $(-½)V_x$ with regard to the reference point. A base of the transistor Q93 receives an input voltage $[(½)V_x-V_y]$ with regard to the reference point. A base of the transistor Q94 receives an input voltage $[(-½)V_x-V_y]$ with regard to the reference point.

An output current $I_L$ is derived from the coupled collectors of the transistors Q91 and Q94. Another output current $I_R$ is derived from the coupled collectors of the transistors Q92 and Q93.

With the conventional multiplier core circuit of FIG. 9, $V_1=(½)V_x$, $V_2=(-½)V_x$, $V_3=(½)V_x-V_y$, and $V_4=(-½)V_x-V_y$. Therefore, the differential output current ΔI is expressed as the following equation (20) from the equation (18).

$$\Delta I = \alpha_F I_0 \tanh\left(\frac{V_x}{2V_T}\right)\tanh\left(\frac{V_y}{2V_T}\right) \tag{20}$$

The equation (20) is the same as the equation (19).

The right-hand side of the equation (19) or (20) multiplied by $\alpha_F$ is equal to the differential output current of the well-known Guilbert multiplier cell.

A value of $\alpha_F$ obtainable through typical bipolar processes is in the range from 0.98 to 0.99, which is extremely near 1. Therefore, it is seen from the equations (19) and (20) that the conventional multiplier core circuits of FIGS. 8 and 9 have the transfer characteristics approximately equal to that of the Gilbert multiplier cell.

Also, since the conventional multiplier core circuits of FIGS. 8 and 9 do not contain the transistors stacked as in the Gilbert cell, they can operate at a lower voltage than the Gilbert's one.

In addition, if the coupled emitters of the transistors Q81, Q82, Q83 and Q84 are grounded in the circuit of FIG. 8, the differential output current ΔI is given by the following equation (21).

$$\Delta I = 4I_0 \sinh\left(\frac{V_x}{2V_T}\right)\sinh\left(\frac{V_y}{2V_T}\right) \tag{21}$$

Similarly, if the coupled emitters of the transistors Q91, Q92, Q93 and Q94 are grounded in the circuit of FIG. 9, the differential output current ΔI is given by the following equation (22).

$$\Delta I = 4I_0 \exp\left(-\frac{V_x}{2V_T}\right)\sinh\left(\frac{V_y}{2V_T}\right)\sinh\left(\frac{V_x}{2V_T}\right) \tag{22}$$

In the equations (21) and (22), $I_0=I_S\exp(V_R/V_T)$.

The conventional MOS or bipolar multiplier core circuits described above have the following problems.

The above conventional MOS multiplier core circuits of FIGS. 3, 4, 5 and 6 can operate at a low-voltage such as 3 v. However, the input circuit becomes rather large in scale, which leads to enlargement in circuit scale for the multiplier itself.

Also, with the conventional MOS multiplier core circuits of FIGS. 1, 3, 4, 5 and 6 containing the quadritail circuit, the maximum obtainable circuit current is limited by the constant tail current $I_0$. Accordingly, the input voltage range is limited by the tail current.

With the conventional MOS multiplier core circuit of FIG. 2 containing the grounded sources, since an obtainable maximum circuit current is not limited by the constant tail current $I_0$, a wider input voltage range can be obtained than the case of the quadritail circuit. However, this circuit is not preferable for LSI because the sources of the MOSFETs are grounded.

The above conventional bipolar multiplier core circuits of FIGS. 7 and 8 also can operate at a low-voltage such as 3 V. However, there is a problem that the input voltage range is not satisfactorily wide. Further, in the case of the grounded emitters, no multiplier characteristic can be obtained, as shown in the equation (21) or (22).

SUMMARY OF THE INVENTION

Accordingly, an object of the present invention is to provide a multiplier core circuit that has a novel circuit configuration in which wide input voltage ranges for superior linearity can be obtained and that is preferable for LSI.

A multiplier core circuit according to a first aspect of the present invention has a quadritail circuit formed of first, second, third and fourth transistors whose emitters or sources are coupled together. Collectors or drains of the first and fourth transistors are coupled together and collectors or drains of the second and third transistors are coupled together.

The quadritail circuit is driven by a tail current through the coupled emitters or sources.

A sum of a first input signal and a second input signal to be multiplied is applied to a base or gate of the first transistor with regard to a reference point. The first input signal is applied to a base or gate of the second transistor with regard to said reference point. The second input signal is applied to a base or gate of the third transistor with regard to the reference point.

Neither the first input signal nor the second input signal are applied to a base or gate of the fourth transistor.

An output signal showing the result of multiplication of the first and second input signals is differentially derived between the collectors or drains of the first and fourth transistors and the collectors or drains of the second and third transistors.

With the multiplier core circuit according to the first aspect, a sum of the first and second input signals is applied to a base or gate of the first transistor with regard to a reference point, the first input signal is applied to a base or gate of the second transistor with regard to said reference point, the second input signal is applied to a base or gate of the third transistor with regard to the reference point, and neither the first input signal nor the second input signal are applied to a base or gate of the fourth transistor.

Therefore, this multiplier core circuit has a novel circuit configuration and wide input voltage ranges for superior linearity. Also, the circuit configuration is preferable for LSI.

A multiplier core circuit according to a second aspect of the present invention is the same in configuration as the multiplier core circuit according to the first aspect except for the input signals. In the circuit of the second aspect, if the first and second input signals are defined as $V_x$ and $V_y$, the gate of the first FET receives $(uV_x+vV_y)$, the gate of the second FET receives $[(u-w)V_x+vV_y]$, the gate of the third FET receives $[uV_x+(v-1/w)V_y]$, and the gate of the fourth FET receives $[(u-w)V_x+(v-1/w)V_y]$, where u, v and w are constants.

Therefore, this multiplier core circuit of the second aspect has a novel circuit configuration and wide input voltage ranges for superior linearity. Also, the circuit configuration is preferable for LSI.

A multiplier core circuit according to the third aspect of the present invention is the same in configuration as the multiplier core circuit according to the first aspect except for the input signals. In the circuit of the third aspect, if the first and second input signals are defined as $V_x$ and $V_y$, the base of the first bipolar transistor receives $(uV_x+vV_y)$, the base of the second bipolar transistor receives $[(u-1)V_x+vV_y]$, the base of the third bipolar transistor receives $[uV_x+(v-1)V_y]$, and the base of the fourth bipolar transistor receives $[(u-1)V_x+(v-1)V_y]$, where u and v are constants.

Therefore, this multiplier core circuit of the third aspect has a novel circuit configuration and wide input voltage ranges for superior linearity. Also, the circuit configuration is preferable for LSI.

A multiplier core circuit according to a fourth aspect of the present invention has first, second, third and fourth FETs whose sources are grounded. Drains of the first and fourth FETs are coupled together and drains of the second and third FETs are coupled together.

A sum of the first input signal and a second input signal to be multiplied is applied to a gate of the first FET with regard to a reference point. The first input signal is applied to a gate of the second FET with regard to the reference point. The second input signal is applied to a gate of the third FET with regard to the reference point.

Neither the first input signal nor the second input signal are applied to a gate of the fourth FET.

An output signal showing the result of multiplication of the first and second input signals is differentially derived between the drains of the first and fourth FETs and the drains of the second and third FETs.

Therefore, this multiplier core circuit of the fourth aspect has a novel circuit configuration and wide input voltage ranges for superior linearity. Also, the circuit configuration is preferable for LSI.

In the multiplier core circuits of the first, second, third and fourth aspects, the first, second, third and fourth transistors may be FETs such as MOSFETs or bipolar transistors.

An analog multiplier according to a fifth aspect has the multiplier core circuit of the first, second, third or fourth aspect.

A preferred embodiment of the multiplier includes an input circuit through which the first and second input signals are applied to the core circuit. The input circuit contains first, second, third and fourth cascode subcircuits for the first, second, third and fourth transistors, respectively. This provides an advantage of a good frequency characteristic.

Another preferred embodiment of the multiplier includes an input circuit through which the first and second input signals are applied to the core circuit in which the input circuit contains a first differential pair for the first and second transistors and a second differential pair for the for the third and fourth transistors. This provides an advantage of a reduced circuit scale.

In still another preferred embodiment of the multiplier, an input circuit through which the first and second input signals are applied to the core circuit contains a voltage divider for the first, second, third and fourth transistors. This provides an advantage of enlarged input voltage ranges.

DETAILED DESCRIPTION OF THE PREFERRED EMBODIMENTS

Preferred embodiments of the present invention will be described below referring to FIGS. 10 to 31.

First Embodiment

Figure 10:
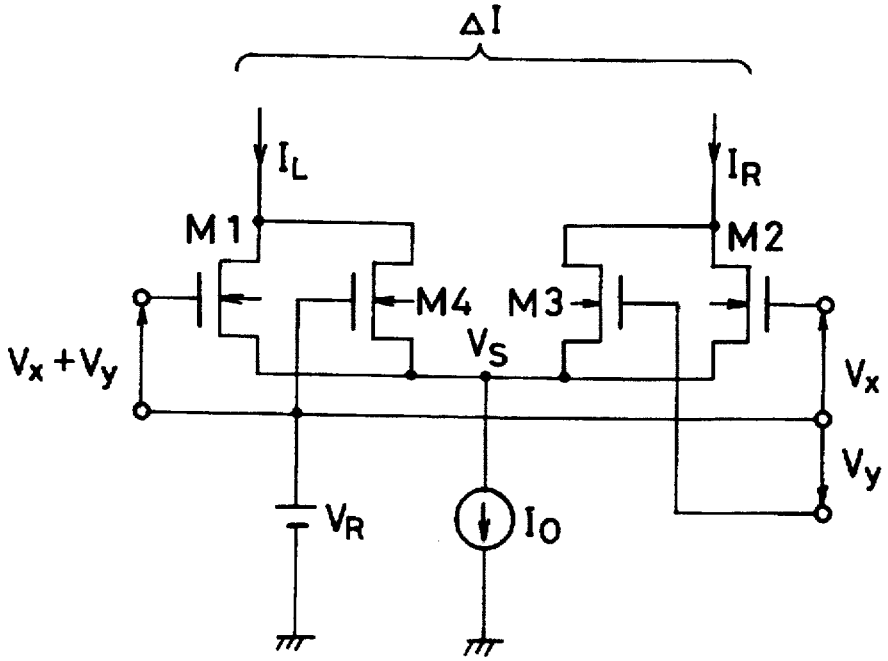
FIG. 10 is a circuit diagram showing a MOS multiplier core circuit according to a first embodiment of the present invention, which contains a quadritail circuit.

FIG. 10 shows a four-quadrant multiplier core circuit according to a first embodiment of the present invention, which is composed of MOSFETs.

In FIG. 10, a quadritail circuit is formed of four p-channel MOSFETs M1, M2, M3 and M4 and a constant current source (current: $I_O$) for driving the quadritail circuit. The MOSFETs M1, M2, M3 and M4 have the same transconductance parameter β.

Sources of the MOSFETs M1, M2, M3 and M4 are coupled together. The constant current source is connected to the coupled sources and the ground, respectively. Drains of the MOSFETs M1 and M4 are coupled together. Drains of the MOSFETs M2 and M3 are coupled together.

A gate of the MOSFET M1 receives input voltage ($V_x$+$V_y$) with regard to a reference point, where $V_x$ and $V_y$ are the input signals to be multiplied. A gate of the MOSFET M2 receives an input voltage $V_x$ with regard to the reference point. A gate of the MOSFET M3 receives input voltage $V_y$ with regard to the reference point. A gate of the MOSFET M4 receives no input voltage.

A voltage source (voltage: $V_R$) is provided between the reference point and the ground. The reference point is held at a reference voltage $V_R$ with regard to the ground.

An output current $I_L$ is derived from the coupled drains of the MOSFETs M1 and M4. Another output current $I_R$ is derived from the coupled drains of the MOSFETs M2 and M3. A differential output current ΔI of the multiplier core circuit is defined as $\Delta I=I_L-I_R$.

Drain currents $I_{D1}$, $I_{D2}$, $I_{D3}$ and $I_{D4}$ Of the MOSFETs M1, M2, M3 and M4 are expressed as the following equations (23), (24), (25) and (26), respectively, where $V_S$ is the common source voltage.

$$I_{D1}=\beta(V_x+V_y+V_R-V_{TH})^2 \quad (23)$$

$$I_{D2}=\beta(V_x+V_R+V_S-V_{TH})^2 \quad (24)$$

$$I_{D3}=\beta(V_y+V_R+V_S-V_{TH})^2 \quad (25)$$

$$I_{D4}=\beta(V_R+V_R+V_{TH})^2 \quad (26)$$

Also, since the MOSFETs M1, M2, M3 and M4 are driven by the tail current $I_O$, the following equation (27) is established.

$$I_{D1}+I_{D2}+I_{D3}+I_{D4}=I_0 \quad (27)$$

Therefore, the differential output current ΔI of the multiplier core circuit can be given as the following equations (28a), (28b) and (28c)

$$\begin{aligned}\Delta I &= I_L - I_R = (I_{D1}+I_{D4})-(I_{D2}+I_{D3}) \quad (28a)\\ &= 2\beta V_x V_y \left( V_x^2+V_y^2+|V_xV_y| \leqq \frac{I_0}{2\beta} \right)\end{aligned}$$

-continued $$\Delta I = I_L - I_R = (I_{D1} + I_{D4}) - (I_{D2} + I_{D3}) \tag{28b}$$
$$= \frac{4}{3}\beta V_x V_y - \frac{1}{9}\,\mathrm{sgn}(V_x V_y)\{3I_0 + \beta(|V_x| + |V_y|)^2 - 4\beta(|V_x| + |V_y|)\} \times \sqrt{\frac{3I_0}{\beta} - 2(|V_x| + |V_y|)^2 + 6|V_x V_y|}$$
$$\left(V_x^2 + V_y^2 + |V_x V_y| \geqq \frac{I_0}{2\beta} \geqq V_x^2 + V_y^2 - \frac{5}{3}|V_x V_y|\right)$$

$$\Delta I = I_L - I_R = (I_{D1} + I_{D4}) - (I_{D2} + I_{D3}) \tag{28c}$$
$$= \left(\beta V_y \sqrt{\frac{I_0}{\beta} - V_y^2}\right) sgn(V_x)$$
$$\left(V_x^2 + V_y^2 - \frac{5}{3}|V_x V_y| \geqq \frac{I_0}{2\beta}\right)$$

Figure 1:
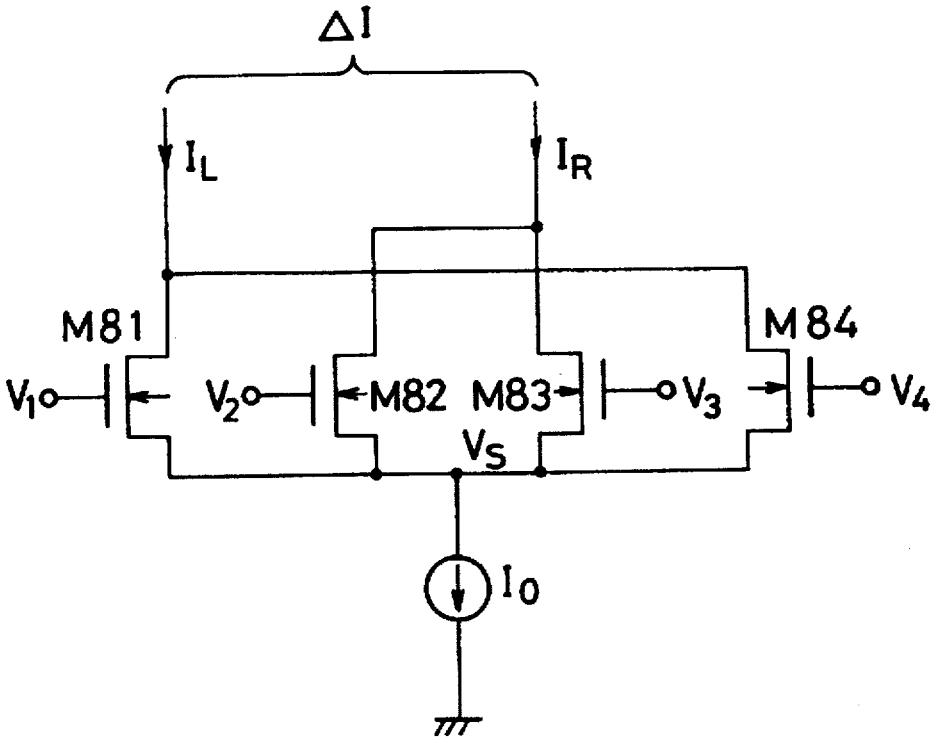
FIG. 1 PRIOR ART
FIG. 1 is a circuit diagram showing a first example of the conventional MOS multiplier core circuit which is a basic or typical circuit and contains a quadritail circuit.
Figure 2:
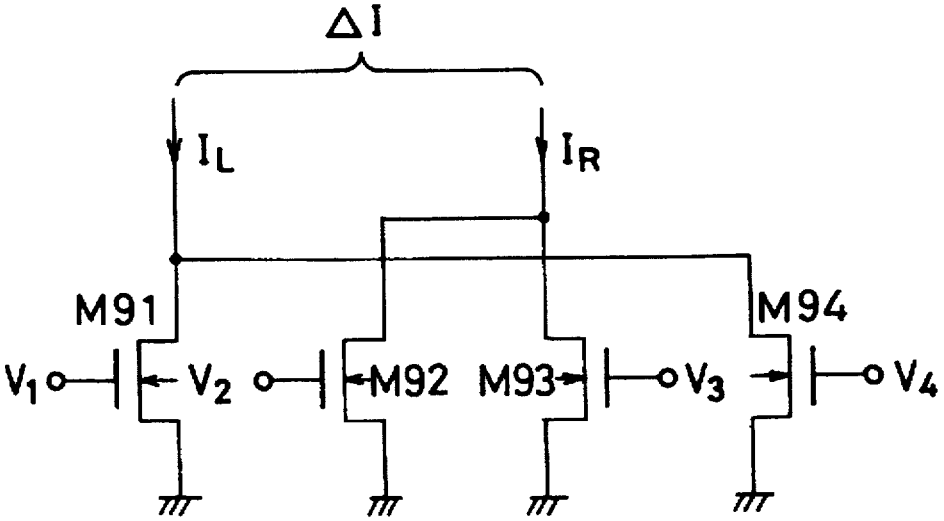
FIG. 2 PRIOR ART
FIG. 2 is a circuit diagram showing a second example of the conventional MOS multiplier core circuit which contains the grounded sources of the MOSFETs.
Figure 3:
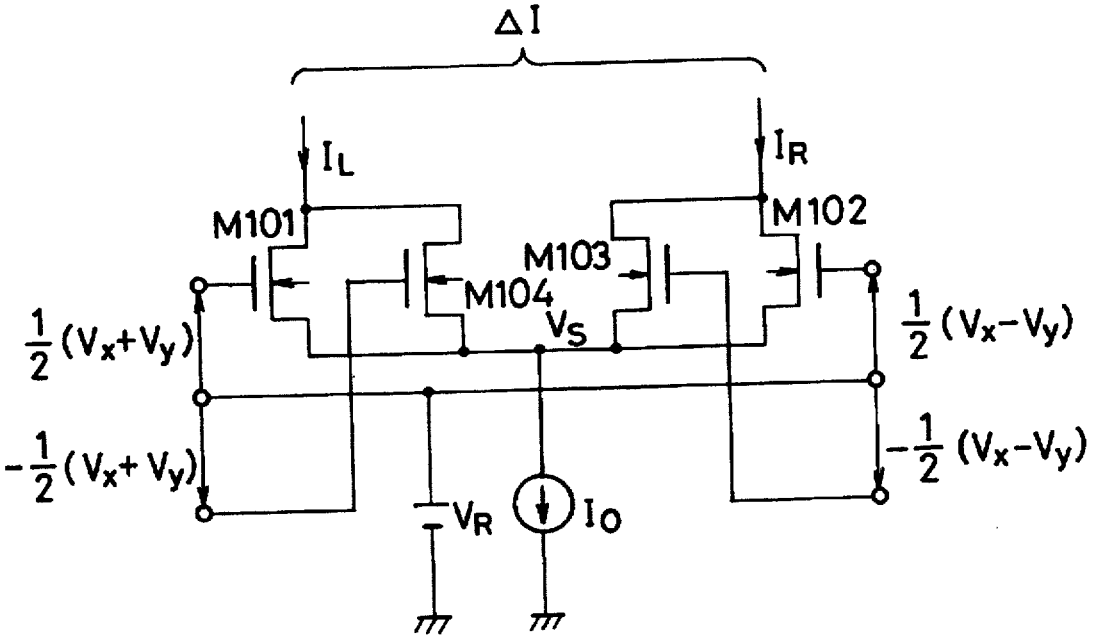
FIG. 3 PRIOR ART
FIG. 3 is a circuit diagram showing a third example of the conventional MOS multiplier core circuit which contains a quadritail circuit and was disclosed by Bult and Wallinga.
Figure 5:
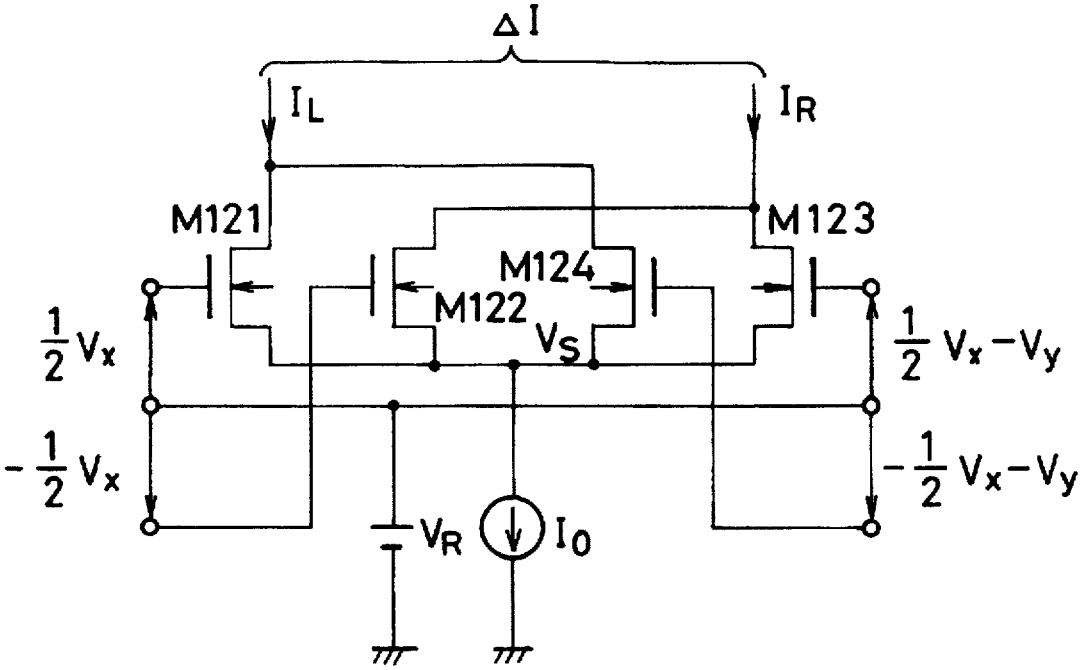
FIG. 5 PRIOR ART
FIG. 5 is a circuit diagram showing a fifth example of the conventional MOS multiplier core circuit which contains a quadritail circuit and was redisclosed by Wang.

The equation (28a) is the same as that of the multiplier core circuit of FIG. 3 shown by Bult and Wallinga and that of the multiplier core circuit of FIG. 5 shown by Wang, which was originally developed by Bult.

Therefore, the MOS multiplier core circuit of the first embodiment can provide an ideal multiplier characteristic within the ranges where none of the MOSFETs M1, M2, M3 and M4 are cut off.

However, as the input voltages $V_x$ and $V_y$ increase, the MOSFETs M1, M2, M3 and M4 start to be cut off, resulting in deviation from the ideal multiplier characteristic.

Figure 11:
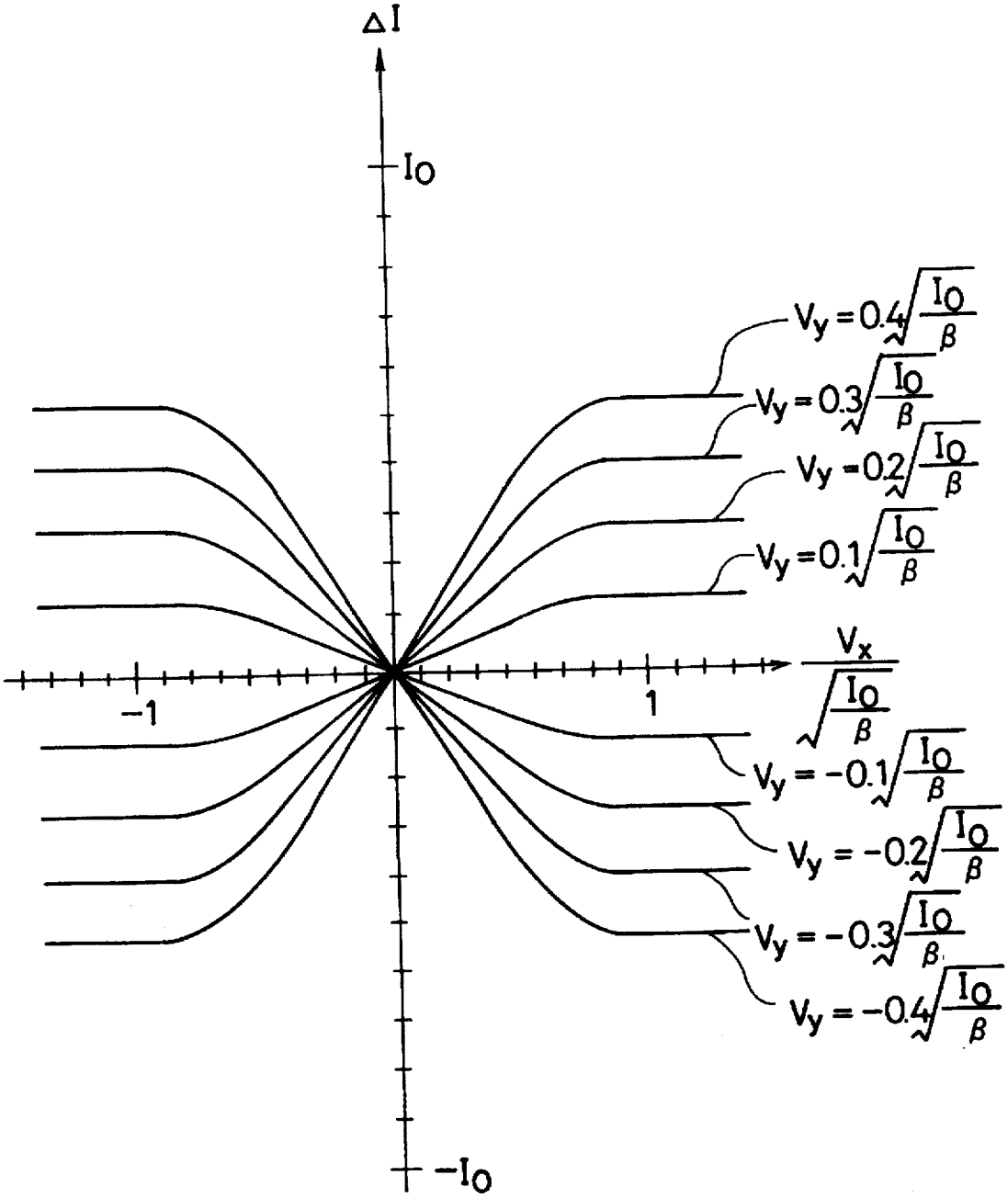
FIG. 11 shows the transfer characteristic of the multiplier core circuit of FIG. 10.

FIG. 11 shows the transconductance characteristic of the multiplier core circuit of the first embodiment with the input voltage $V_y$ as a parameter, which is obtained by the equations (28a), (28b) and (28c).

Figure 12:
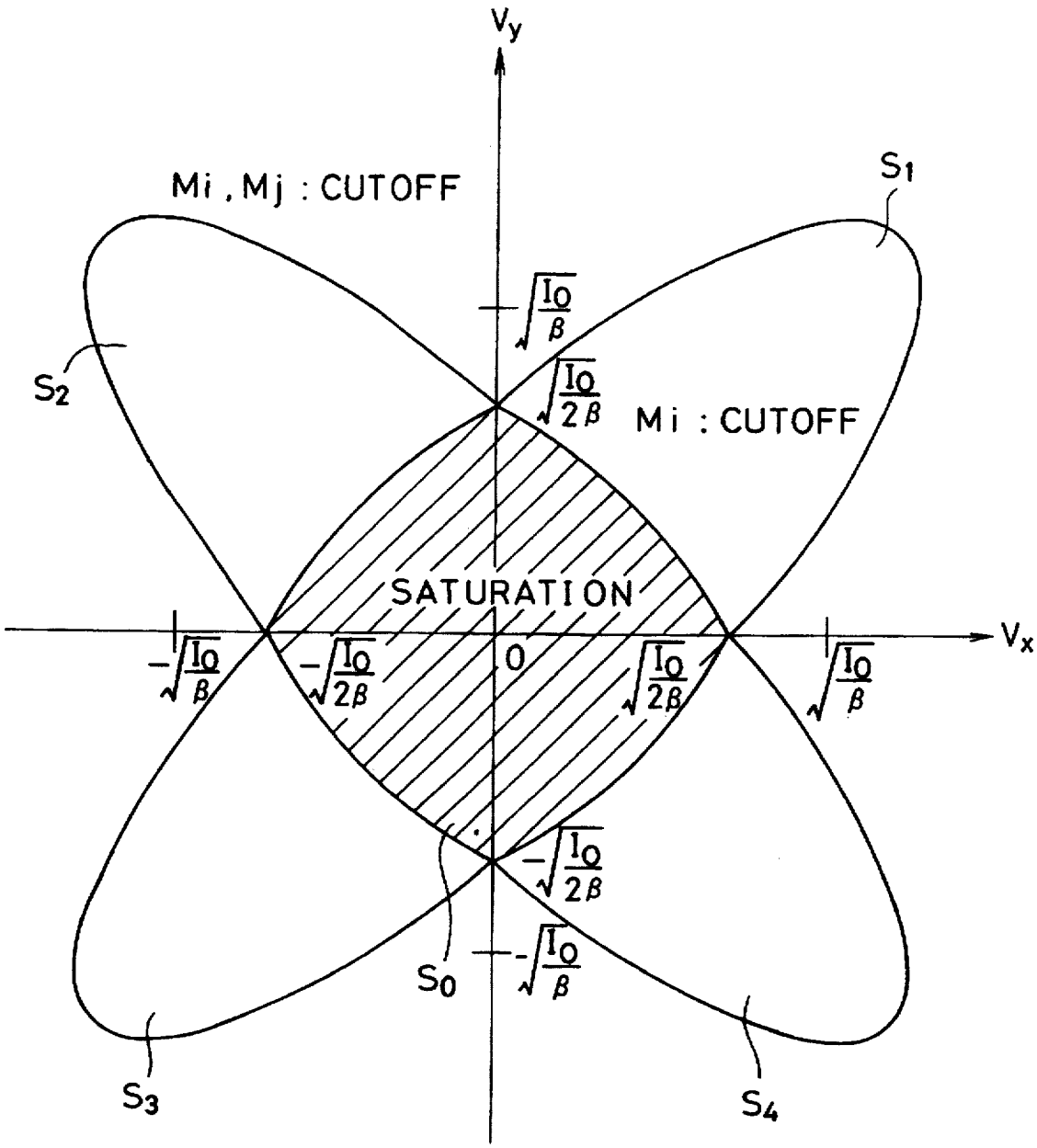
FIG. 12 shows the relationship between the input voltage ranges of $V_x$ and $V_y$ and the operating situations of the MOSFETS according to the multiplier core circuit of FIG. 10.

FIG. 12 shows the operating region for the input voltages $V_x$ and $V_y$ of the multiplier core circuit of the first embodiment. In FIG. 12, the central, hatched area $S_0$ denotes the normally operating region that corresponds to the equation (28a), four protruding area $S_1$, $S_2$, $S_3$ and $S_4$ from the region $S_0$ denote the abnormally operating region that corresponds to the equation (28b), and the remaining area denotes the non-operating region that corresponds to the equation (28c).

Typically, the transconductance characteristics of the multiplier core circuit for the input voltages $V_x$ and $V_y$ are the same as each other. Then, to obtain the transconductance characteristic of the multiplier core circuit of the first embodiment, the equations (28a), (28b) and (28c) are differentiated by $V_y$, resulting in the equations (29a), (29b) and (29c).

$$\frac{d(\Delta I)}{dV_x} = 2\beta V_y\left(V_x^2 + V_y^2 + |V_x V_y| \leqq \frac{I_0}{2\beta}\right) \tag{29a}$$

$$\frac{d(\Delta I)}{dV_x} = \frac{4}{3}\beta V_y - \frac{4}{9}\,sgn(V_x V_y)\left\{(|V_x| + |V_y|) + \frac{4\beta(|V_x| + |V_y|)^2}{\sqrt{\frac{3I_0}{\beta} - 2(|V_x| + |V_y|)^2 + 6|V_x V_y|}}\right\} \tag{29b}$$
$$\left(V_x^2 + V_y^2 + |V_x V_y| \geqq \frac{I_0}{2\beta} \geqq V_x^2 + V_y^2 - \frac{5}{3}|V_x V_y|\right)$$

$$\frac{d(\Delta I)}{dV_x} = 0\left(V_x^2 + V_y^2 - \frac{5}{3}|V_x V_y| \geqq \frac{I_0}{2\beta}\right) \tag{29c}$$

Figure 13:
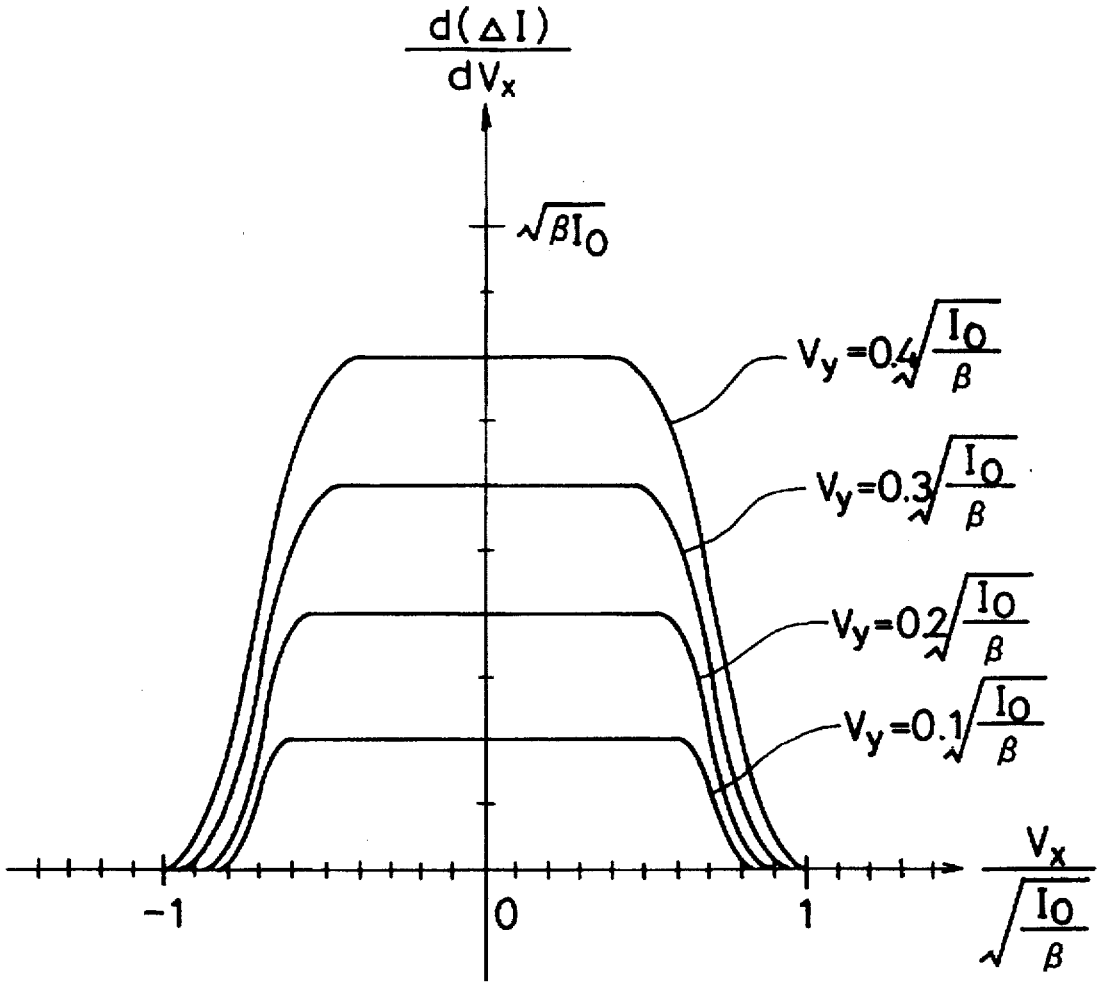
FIG. 13 shows the transconductance characteristic of the multiplier core circuit of FIG. 10.

FIG. 13 shows the transconductance characteristic of the multiplier core circuit of the first embodiment with the voltage $V_y$ as a parameter, which is obtained by the equations (29a), (29b) and (29c).

As described above, the multiplier core circuit of the first embodiment has a novel circuit configuration. Also, the circuit is preferable for LSI because the quadritail circuit is driven by the constant tail current $I_0$.

Further, this multiplier core circuit can be fabricated through CMOS processes.

Second Embodiment

Figure 14:
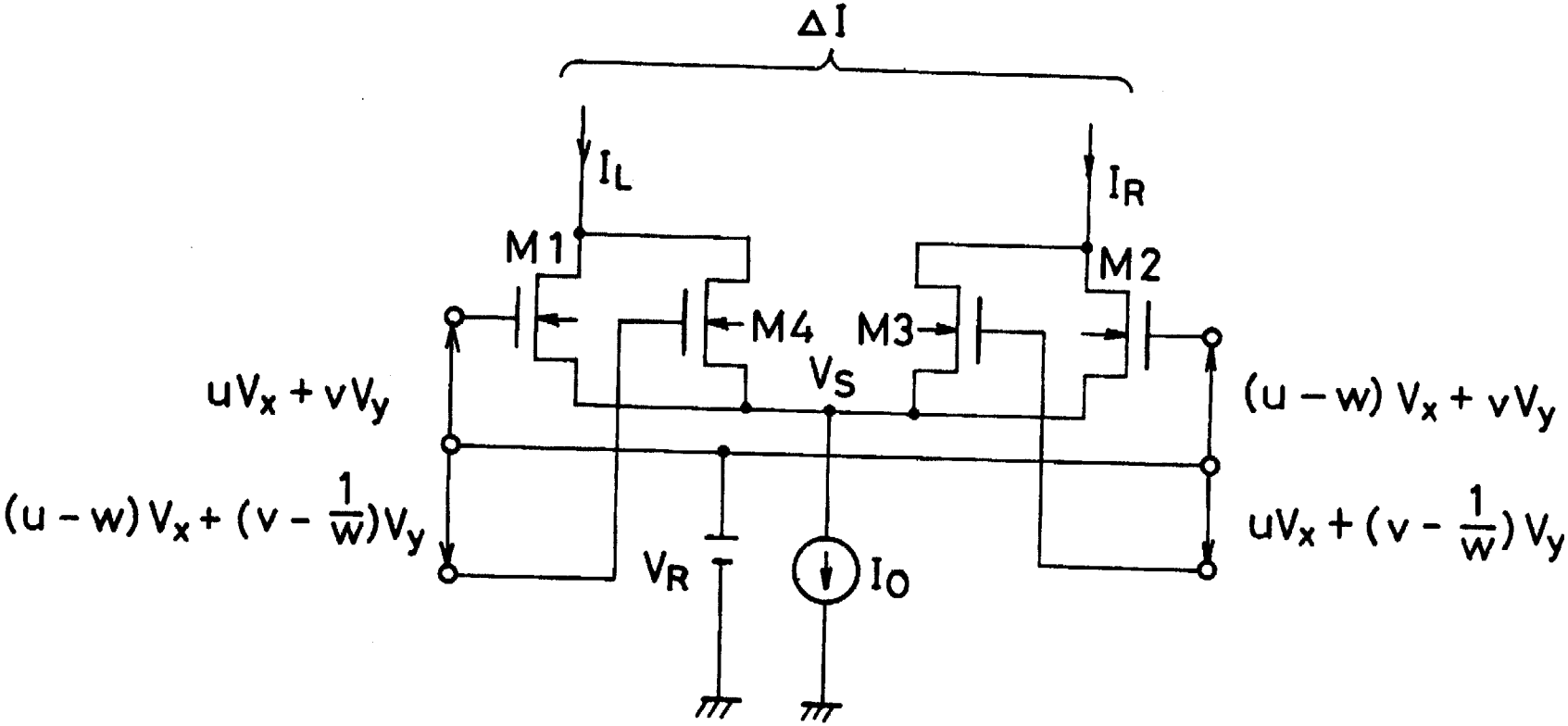
FIG. 14 is a circuit diagram showing a MOS multiplier core circuit according to a second embodiment of the present invention, which contains a quadritail circuit.

FIG. 14 shows a four-quadrant multiplier core circuit according to a second embodiment of the present invention, which is composed of MOSFETs.

The circuit of the second embodiment has the same configuration as that of the circuit of the first embodiment except for the input voltages, which is equivalent to a generalized one of the MOS multiplier core circuit containing the quadritail circuit.

To realize a multiplier characteristic for the input voltages $V_x$ and $V_y$ to be multiplied, the input voltages $V_1$, $V_2$, $V_3$ and $V_4$ to the respective MOSFETs M1, M2, M3 and M4 can be expressed by the following generalized equations (30), (31), (32) and (33), respectively, where u, v and w are constants.

$$V_1 = uV_x + vV_y \tag{30}$$

$$V_2 = (u - w)V_x + vV_y \tag{31}$$

$$V_3 = uV_x + \left(v - \frac{1}{w}\right)V_y \tag{32}$$

$$V_4 = (u - w)V_x + \left(v - \frac{1}{w}\right)V_y \tag{33}$$

If none of the MOSFETs M1, M2, M3 and M4 are pinched off, the differential output current ΔI of this multiplier core circuit is given as the following equation (34) using the equations (30), (31), (32) and (33).

$$\Delta I = (I_{D1} + I_{D4}) - (I_{D2} + I_{D3}) = 2\beta V_x V_y \tag{34}$$

It is seen from the equation (34) that the core circuit of the second embodiment has the multiplier characteristic and that the constants u, v and w do not appear because they are cancelled.

For example, if u=w=½ and w=1 in the equations (30), (31), (32) and (33), the conventional multiplier core circuit of FIG. 3 developed by Bult and Wallinga is obtained.

Figure 6:
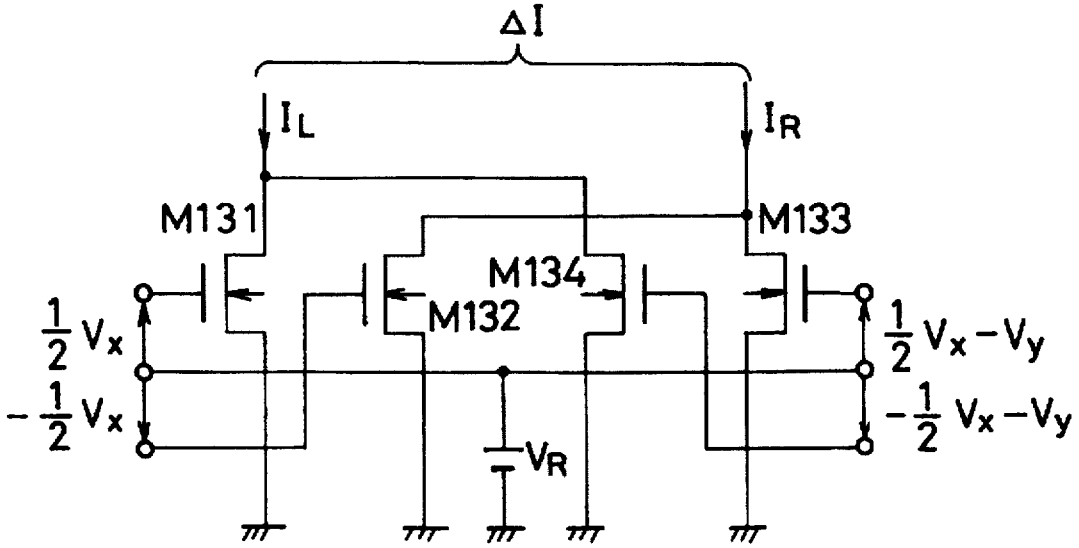
FIG. 6 PRIOR ART
FIG. 6 is a circuit diagram showing a sixth example of the conventional MOS multiplier core circuit which was disclosed by Wu and Schaumann.
Figure 7:
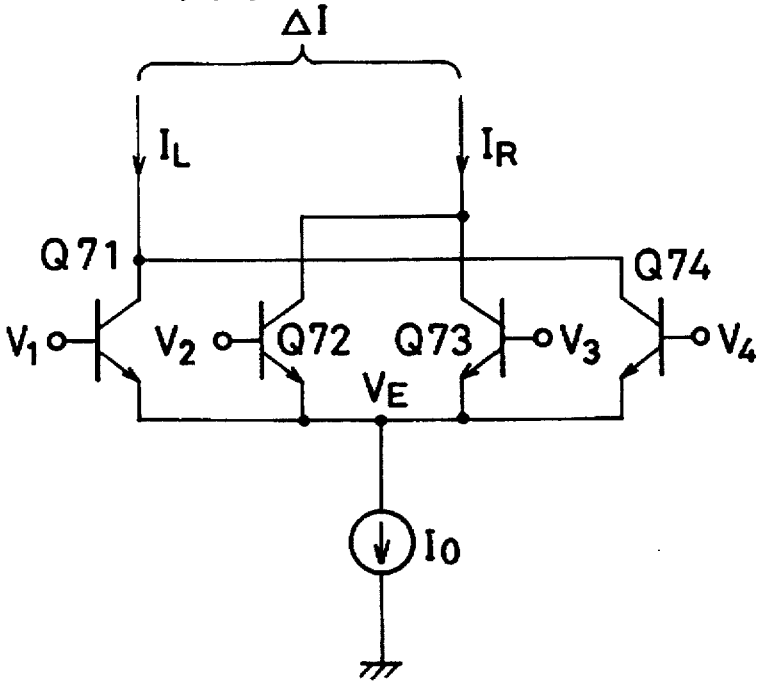
FIG. 7 PRIOR ART
FIG. 7 is a circuit diagram showing a first example of the conventional bipolar multiplier core circuit which is a basic or typical circuit and contains a quadritail circuit.
Figure 8:
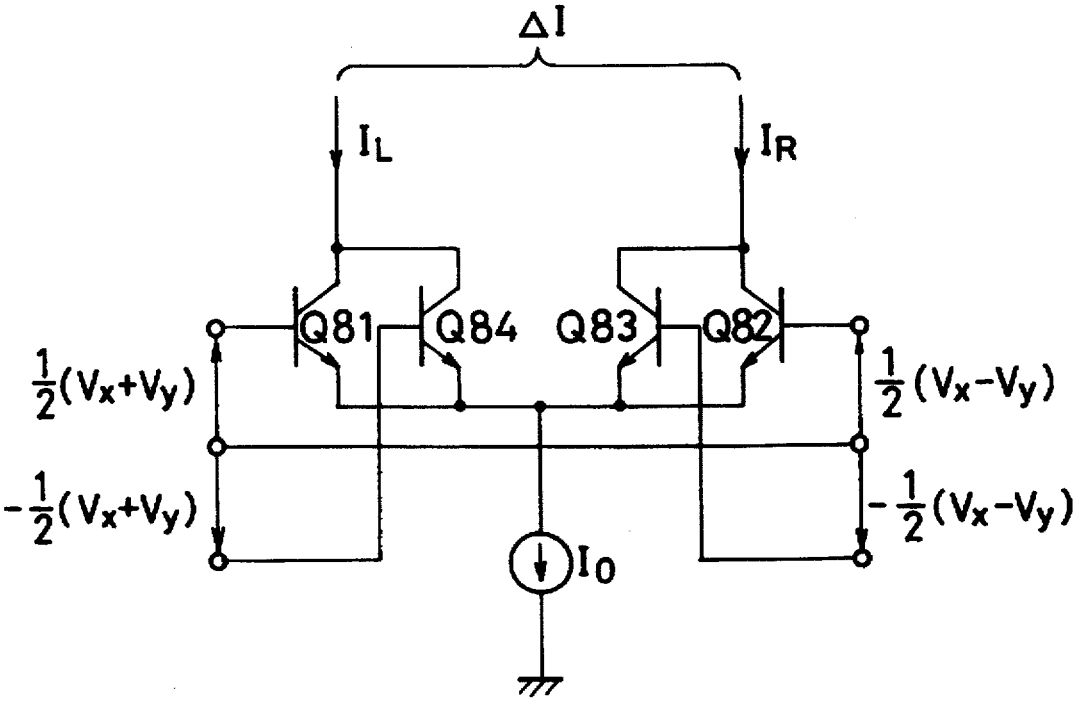
FIG. 8 PRIOR ART
FIG. 8 is a circuit diagram showing a second example of the conventional bipolar multiplier core circuit which contains a quadritail circuit and is obtained based on the circuit of FIG. 3.
Figure 9:
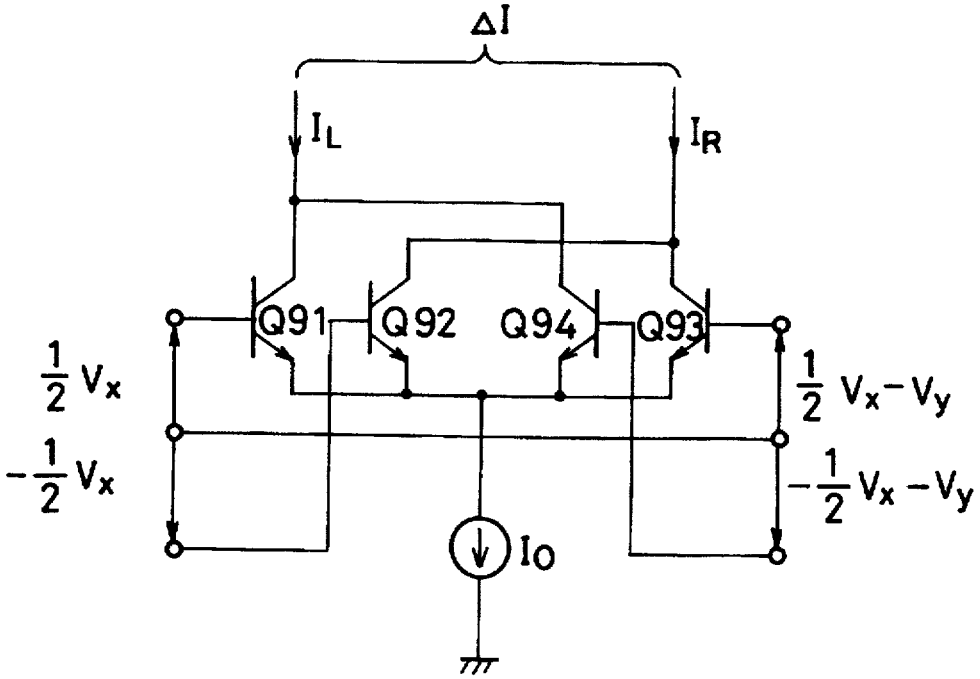
FIG. 9 PRIOR ART
FIG. 9 is a circuit diagram showing a third example of the conventional bipolar multiplier core circuit which contains a quadritail circuit and is obtained based on the circuit of FIG. 5.

Also, if u=½ and v=w=1 in the equations (30), (31), (32) and (33), the conventional multiplier core circuit of FIG. 5 redeveloped by Wang or the circuit of FIG. 6 developed by Wu and Schaumann is obtained.

Further, if u=v=w=1 in the equations (30), (31), (32) and (33), the multiplier core circuit of FIG. 10 according to the first embodiment is obtained.

Third Embodiment

Figure 15:
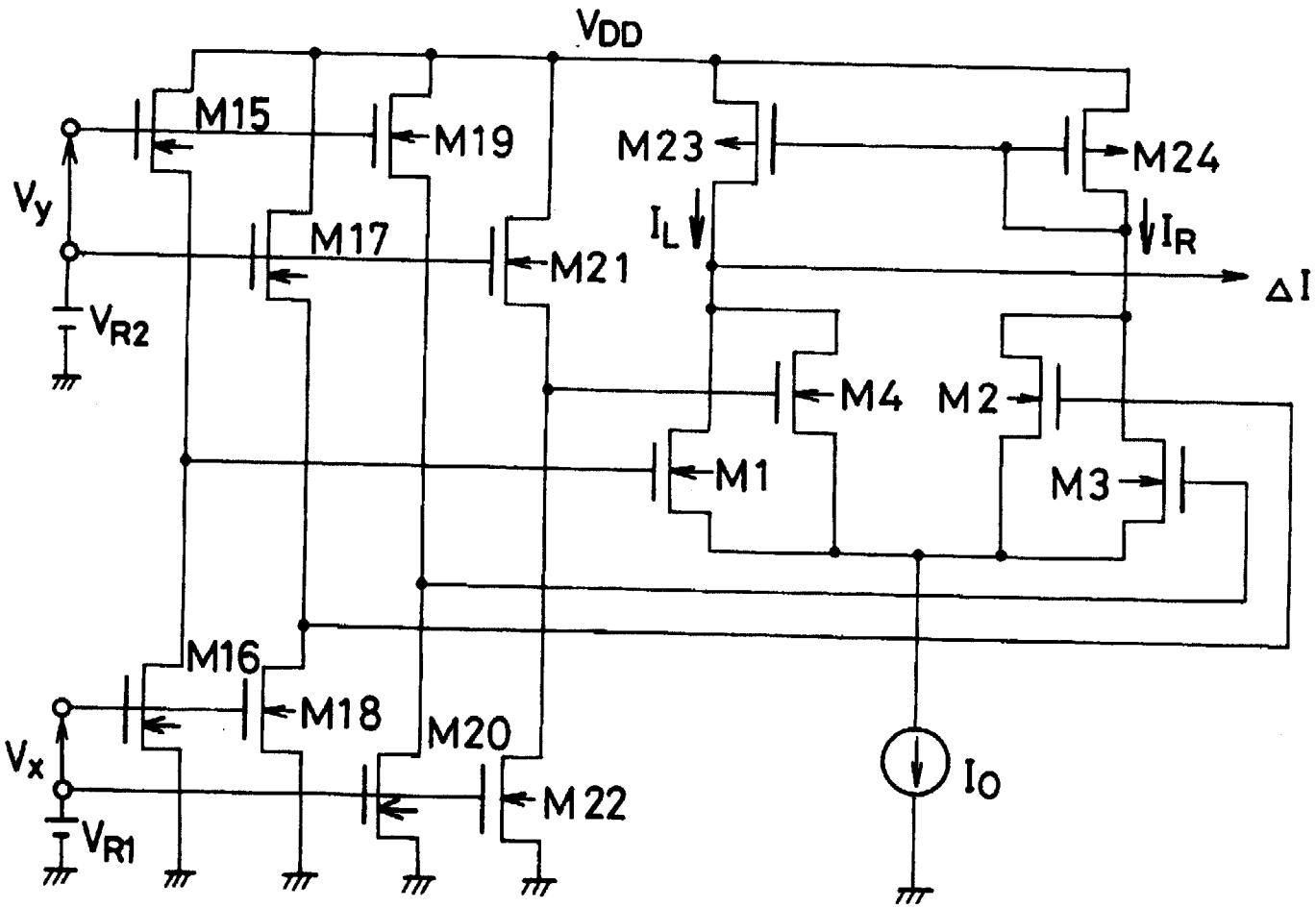
FIG. 15 is a circuit diagram showing a MOS analog multiplier according to a third embodiment of the present invention, which contains the core circuit of FIG. 10.

FIG. 15 shows a four-quadrant analog multiplier according to a third embodiment of the present invention, which contains the multiplier core circuit of FIG. 10 of the first embodiment.

The analog multiplier of the third embodiment has the core circuit of the first embodiment, an input circuit through which the input voltages $V_x$ and $V_y$ are applied to the core circuit, a first voltage source (voltage: $V_{R1}$) connected to a first reference point and the ground, a second voltage source (voltage: $V_{R2}$) connected to a second reference point and the ground, and a current mirror circuit formed of MOSFETs M23 and M24 as an active load.

The input circuit contains a first cascode subcircuit formed of p-channel MOSFETs M15 and M16 for the MOSFET M1, a second cascode subcircuit formed of p-channel MOSFETs M17 and M18 for the MOSFET M2, a third cascode subcircuit formed of p-channel MOSFETs M19 and M20 for the MOSFET M3, a fourth cascode subcircuit formed of p-channel MOSFETs M21 and M22 for the MOSFET M4.

In FIG. 15, the MOSFETs whose drain currents are equal to each other have the gate-source voltages equal to each other in the input circuit. Therefore, the gate-source voltages $V_{GS15}$, $V_{GS16}$, $V_{GS17}$, $V_{GS18}$, $V_{GS19}$, $V_{GS20}$, $V_{GS21}$, and $V_{GS22}$ of the MOSFETs M15, M16, M17, M18, M19, M20, M21 and M22 are given as $V_{GS15}=V_{GS16}=V_{GS17}=V_{GS18}=V_x+V_{R1}$, and $V_{GS19}=V_{GS20}=V_{GS21}=V_{GS22}=V_{R1}$.

Also, the gate voltages of the MOSFETs M15 and M19 are $(V_y+V_{R2})$ and the gate voltages of the MOSFETs M17 and M21 are $V_{R2}$. Therefore, the gate voltages of the MOSFETs M1, M2, M3 and M4 of the multiplier core circuit are given as the following equations (35), (36), (37) and (38), respectively.

$$V_1=(V_y+V_{R2})-(V_x+V_{R1}) \quad (35)$$

$$V_2=V_{R2}-(V_x+V_{R1}) \quad (36)$$

$$V_3=(V_y+V_{R2})-V_{R1} \quad (37)$$

$$V_4=V_{R2}-V_{R1} \quad (38)$$

If the dc reference voltage is $(V_{R2}-V_{R1})$, $V_1=V_y-V_x$, $V_2=-V_x$, $V_3=V_y$, and $V_4=0$. Therefore, it is seen from the equation (34) the differential output current ΔI of the multiplier is proportional to the product of $(-V_x)$ and $V_y$, i.e., $(-V_x)\cdot V_y$.

In the analog multiplier of the third embodiment, because the differential output current ΔI is derived from the coupled drains of the MOSFETs M1 and M4, the current ΔI is opposite in phase to the case of the FIG. 10. In other words, the current ΔI is proportional to $V_x\cdot V_y$.

Fourth Embodiment

Figure 16:
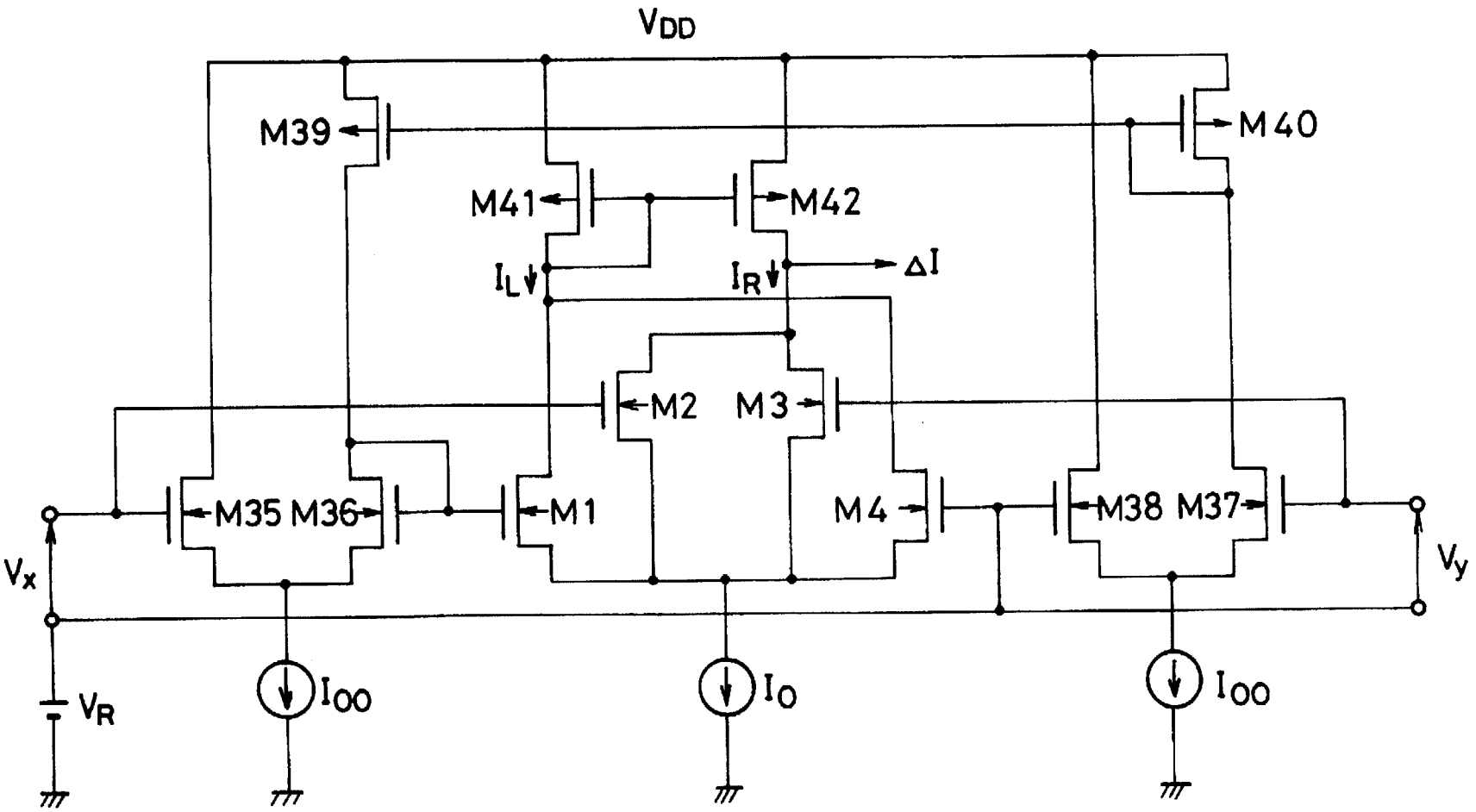
FIG. 16 is a circuit diagram showing a MOS analog multiplier according to a fourth embodiment of the present intention, which contains the Core circuit of FIG. 10.
Figure 17:
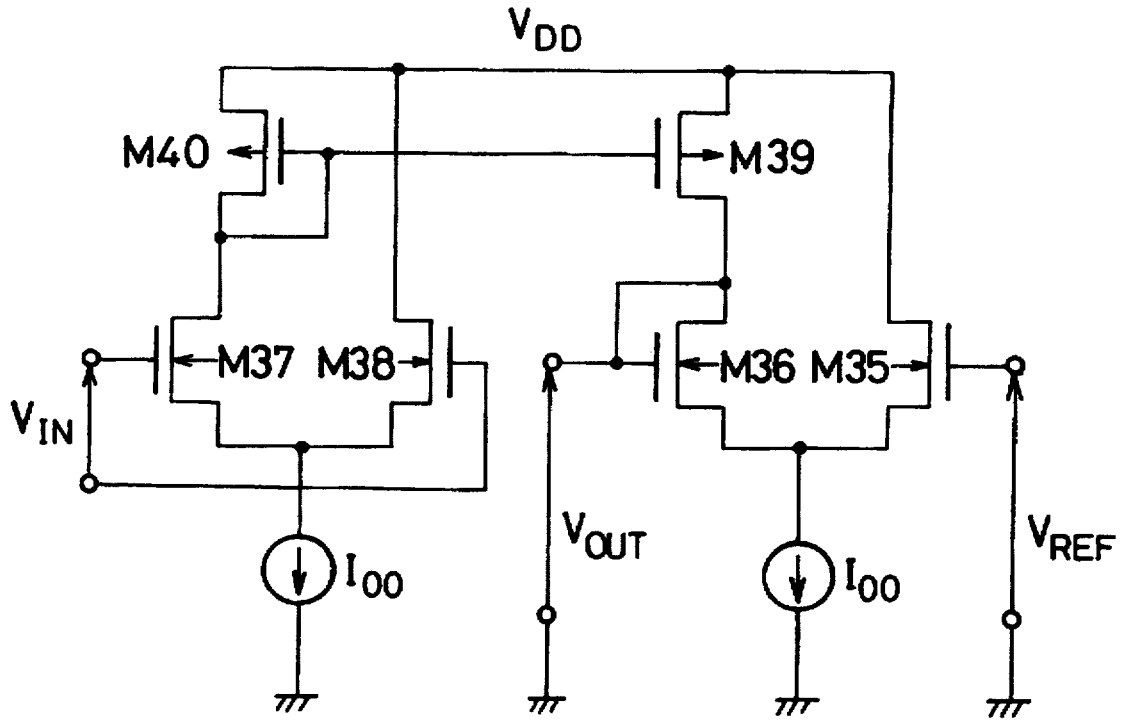
FIG. 17 is a circuit diagram showing the input circuit used in the analog multiplier of FIG. 16.

FIGS. 16 and 17 show a four-quadrant analog multiplier according to a fourth embodiment of the present invention, which contains the multiplier core circuit of FIG. 10 of the first embodiment.

The analog multiplier of the fourth embodiment has the core circuit of the first embodiment formed of the MOSFETs M1, M2, M3 and M4, an input circuit through which the input voltages $V_x$ and $V_y$ are applied 6o the core circuit, a voltage source (voltage: $V_R$) connected to a reference point and the ground, a first current mirror circuit formed of MOSFETs M39 and M40 as an active load of the respective first and second differential pairs, and a second current mirror circuit formed of MOSFETs M41 and M42 as an active load of the core circuit.

The input circuit contains a first differential pair of MOSFETs M35 and M36 for the MOSFETs M1 and M2 whose sources are coupled together, and a second differential pair of MOSFETs M37 and M38 for the MOSFETs M3 and M4 whose sources are coupled together. The first differential pair is driven by a first constant current source (current: $I_{00}$) connected to the coupled sources of the MOSFETs M1 and M2. The second differential pair is driven by a second constant current source (current: $I_{00}$) connected to the coupled sources of the MOSFETs M3 and M4.

FIG. 17 shows the input circuit of the multiplier of FIG. 16, which is apart from the core circuit. In FIG. 17, the following equation (39) is established.

$$V_{OUT}=V_{REF}+V_{IN} \quad (39)$$

The reason is as follows:

Because the first and second differential pairs are connected by the first current mirror circuit of MOSFETs M39 and M40, the drain currents $I_{D37}$ and $I_{D36}$ of the MOSFETs M37 and M36 are equal to each other. Therefore, the gate-source voltages $V_{GS37}$ and $V_{GS36}$ of the MOSFETs M37 and M36 also are equal to each other.

In addition, since the first and second differential pairs are driven by the same constant current $I_{00}$, $I_{D37}+I_{D38}=I_{D35}+I_{D36}=I_{00}$ is established.

Accordingly, the drain currents $I_{D38}$ and $I_{D35}$ of the MOSFETs M38 and M35 are equal to each other, and therefore, the gate-source voltages $V_{GS38}$ and $V_{GS35}$ of the MOSFETs M38 and M35 are equal to each other. As a result, the following equation is obtained $$V_{OUT}-V_{REF}=V_{GS36}-V_{GS35}=V_{GS37}-V_{GS38}=V_{IN}.$$

This equation is the same as the above equation (39).

The analog multiplier of the fourth embodiment is composed of a reduced number of the MOSFETs compared with the conventional analog multiplier of FIG. 3 developed by Bult and Wallinga and that of FIG. 5 redeveloped by Wang. This means that the multiplier of the fourth embodiment is smaller in circuit scale than these conventional multipliers.

Also, the multiplier of the fourth embodiment can operate at a low voltage such as 3 or 3.3 V.

Fifth Embodiment

Figure 18:
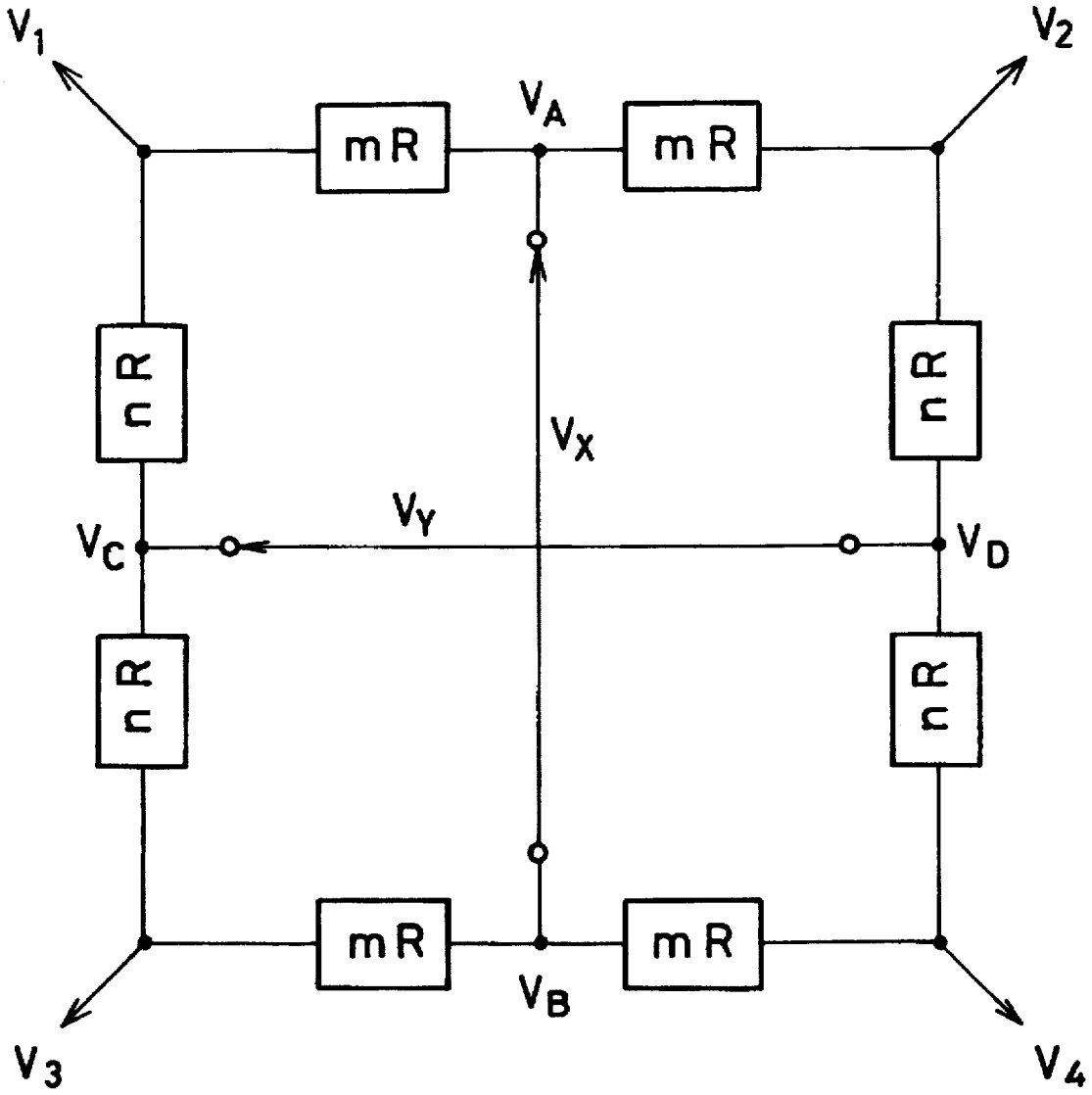
FIG. 18 schematically shows divider circuits used for a MOS multiplier core circuit of FIG. 19.
Figure 19:
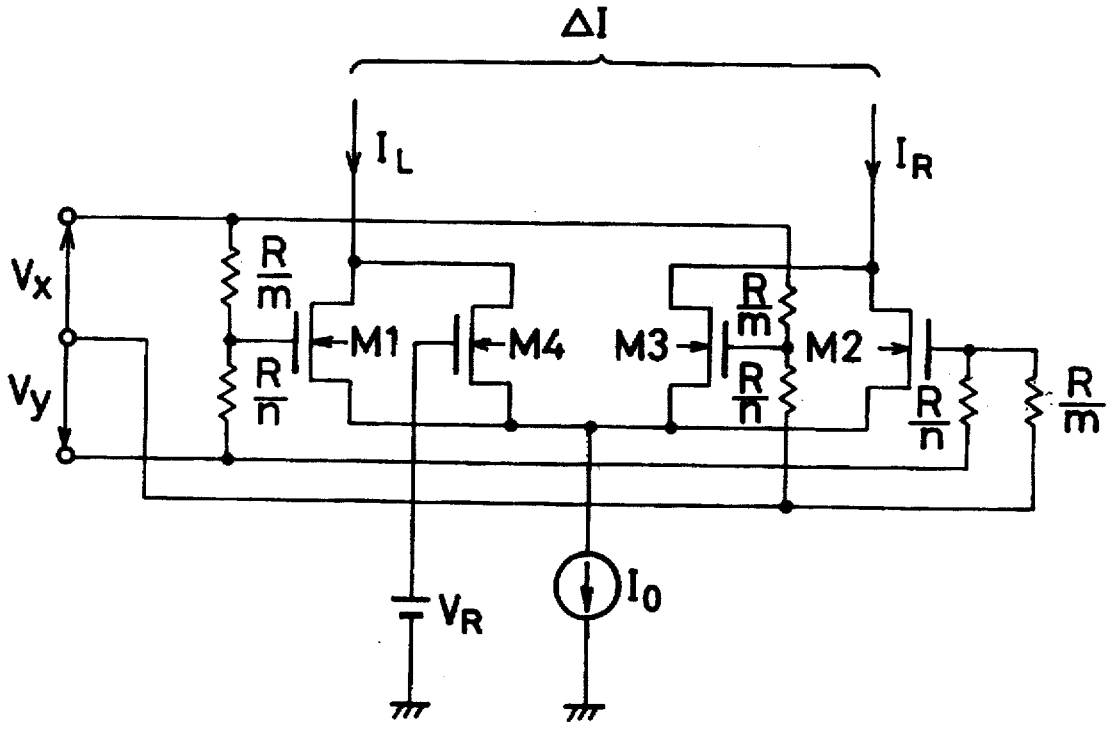
FIG. 19 is a circuit diagram showing a MOS analog multiplier according to a fifth embodiment of the present invention, which contains the divider circuits of FIG. 18.

FIG. 19 shows a four-quadrant analog multiplier according to a fifth embodiment of the present invention, which contains the multiplier core circuit of FIG. 10 of the first embodiment and a voltage divider shown in FIG. 18.

In FIG. 18, the voltage divider contains four pairs of resistors whose resistances are mR and nR. The pairs are connected to the MOSFETs M1, M2, M3 and M4, respectively. If the voltages $V_A$, $V_B$, $V_C$ and $V_D$ are defined to satisfy the equations of $V_A-V_B=V_x$ and $V_C-V_D=V_y$, the input voltages $V_1$, $V_2$, $V_3$ and $V_4$ are expressed as the following equations (40), (41), (42) and (43), respectively, where m and n are constants.

$$V_1=\frac{(mV_C+nV_A)}{(m+n)} \quad (40)$$

$$V_2=\frac{(mV_D+nV_A)}{(m+n)} \quad (41)$$

$$V_3=\frac{(mV_C+nV_B)}{(m+n)} \quad (42)$$

$$V_4=\frac{(mV_D+nV_B)}{(m+n)} \quad (43)$$

Therefore, within the normally operating region of in which none of the MOSFETs M1, M2, M3 and M4 are pinched off, the differential output current ΔI is given by the following equation (44).

$$\Delta I = \frac{2mn\beta}{(m+n)^2} V_x V_y \left( \frac{V_x^2}{n^2} + \frac{V_y^2}{m^2} + \frac{|V_x V_y|}{mn} \leqq \frac{I_0}{2(m+n)^2\beta} \right) \quad (44)$$

It is seen from the equation (44) that the circuit using the voltage divider of FIG. 18 has the multiplier characteristic.

If $V_B=V_D$, the pair of the resistors through which the voltage $v_4$ is applied can be omitted, which corresponds to the multiplier core circuit of the fifth embodiment of FIG. 19.

In FIG. 19, the gate of the MOSFET M1 receives a divided voltage of $(V_x+V_y)[m\cdot n/(m+n)]$. The gate of the MOSFET M2 receives a divided voltage of $V_x[m\cdot n/(m+n)]$. The gate of the MOSFET M3 receives a divided voltage of $V_y[m\cdot n/(m+n)]$. None of the signal voltages are applied to the gate of the MOSFET M4.

With the multiplier core circuit of the fifth embodiment, since the input voltages are divided by $[(m\cdot n/(m+n)]$ to be applied to the respective gates of the MOSFETs M1, M2, M3 and M4, the input voltage range is enlarged to be $[(m\cdot n)/(m+n)]$ times as wide as that of the first embodiment of FIG. 10.

The dc voltage $V_R$ applied to the gate of the MOSFET M4 does not appear in the product $V_x \cdot V_y$ of the differential output current ΔI, even if the input impedance becomes a high specified value. As a result, the technique of inserting the resistors into the input circuit is effective for both voltage stabilization and current consumption reduction. Additionally, the circuit scale is minimized.

Sixth Embodiment

Figure 20:
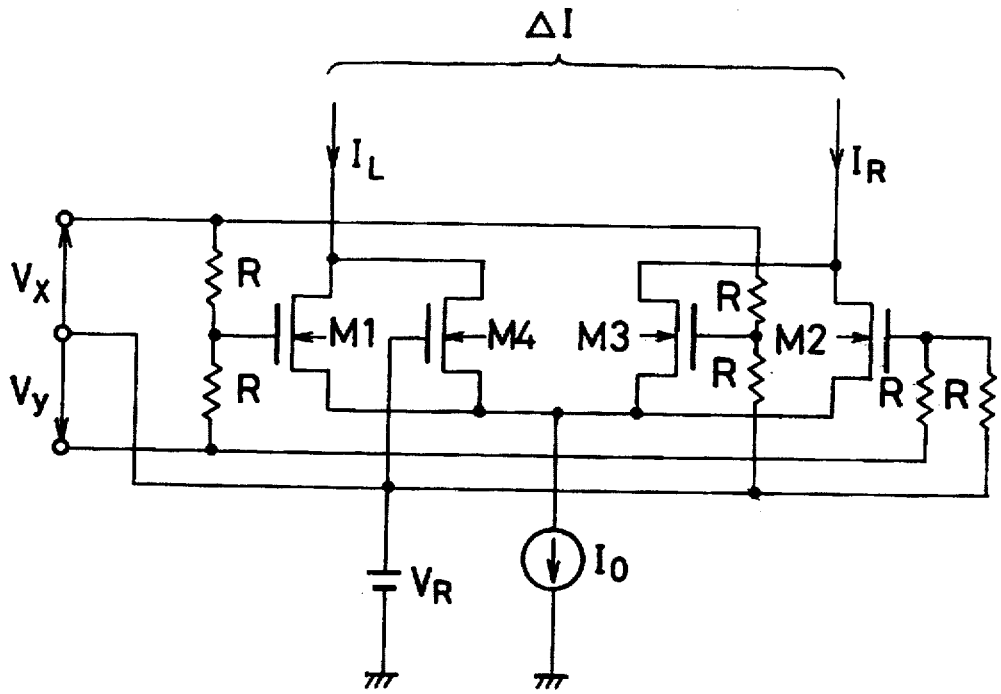
FIG. 20 is a circuit diagram showing a MOS analog multiplier according to a sixth embodiment of the present invention, which contains the divider circuits of FIG. 18.

FIG. 20 shows a four-quadrant analog multiplier according to a sixth embodiment of the present invention, which contains the multiplier core circuit of FIG. 10 of the first embodiment and a voltage divider shown in FIG. 18. This circuit is equivalent to the circuit of FIG. 19 in which m=n=1.

In FIG. 20, the gate of the MOSFET M1 receives a voltage of $(½)(V_x+V_y)$. The gate of the MOSFET M2 receives a voltage of $(½)V_x$. The gate of the MOSFET M3 receives a voltage of $(½)V_y$. None of the signal voltages are applied to the gate of the MOSFET M4.

The differential output current ΔI of the sixth embodiment is given as the following equation (45), which is obtained by setting m=n in the equation (44).

$$\Delta I = \frac{\beta}{2} V_x V_y \left( V_x^2 + V_y^2 + |V_x V_y| \leqq \frac{I_0}{8\beta} \right) \quad (45)$$

With the multiplier core circuit of the sixth embodiment, since the input voltages are divided by two to be applied to the respective gates of the MOSFETs M1, M2, M3 and M4, the input voltage range is enlarged to be twice as wide as that of the first embodiment of FIG. 10.

The same effects or advantages as those of the fifth embodiment are obtained.

Seventh Embodiment

Figure 21:
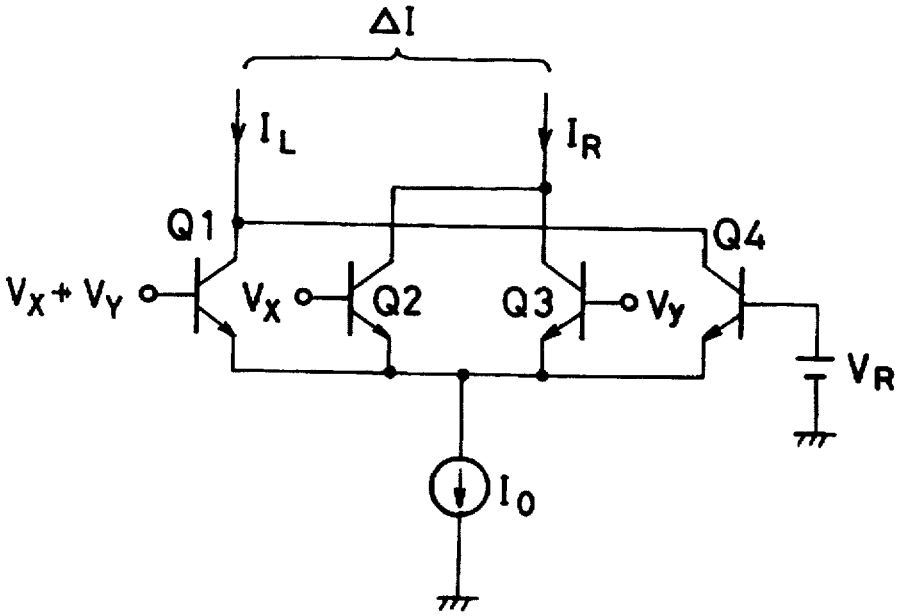
FIG. 21 is a circuit diagram showing a bipolar multiplier core circuit according to a seventh embodiment of the present invention, which contains a quadritail circuit.

FIG. 21 shows a four-quadrant multiplier core circuit according to a seventh embodiment of the present invention, which is equivalent to a multiplier core circuit that is obtained by replacing the MOSFETs M1, M2, M3 and M4 by bipolar transistors Q1, Q2, Q3 and Q4 in the multiplier core circuit of FIG. 10 of the first embodiment.

Specifically, in FIG. 21, a quadritail circuit is formed of four npn-type transistors Q1, Q2, Q3 and Q4 and a constant current source (current: $I_0$) for driving the quadritail circuit. The transistors Q1, Q2, Q3 and Q4 have the same emitter area.

Emitters of the transistors Q1, Q2, Q3 and Q4 are coupled together. The constant current source is connected to the coupled emitters and the ground, respectively. Collectors of the transistors Q1 and Q4 are coupled together. Collectors of the transistors Q2 and Q3 are coupled together.

A base of the transistor Q1 receives an input voltage $(V_x+V_y)$ with regard to a reference point. A base of the transistor Q2 receives an input voltage $V_x$ with regard to the reference point. A base of the transistor Q3 receives an input voltage $V_y$ with regard to the reference point. A base of the transistor Q4 does not receive an input signal voltage.

A voltage source (voltage: $V_R$ ) is provided between the reference point and the ground. The reference point is the base of the transistor Q4 and is held at a reference voltage $V_R$ with regard to the ground.

An output current $I_L$ is derived from the coupled collectors of the transistors Q1 and Q4. Another output current $I_R$ is derived from the coupled collectors of the transistors Q2 and Q3. A differential output current ΔI of the multiplier core circuit is defined as $\Delta I=I_L-I_R$.

Since $V_1=V_x+V_y$, $V_2=V_x$, $V_3=V_y$, $V_4=0$, the differential current ΔI of this bipolar multiplier core circuit is given from the equation (18) as the following equation (46).

$$\Delta I = \alpha_F I_0 \tanh\left(\frac{V_x}{2V_T}\right) \tanh\left(\frac{V_y}{2V_T}\right) \quad (46)$$

The equation (46) is the same as the equation (19) and (20).

The right-hand side of the equation (46)) multiplied by $\alpha_F$ is equal to the differential output current of the well-known Guilbert multiplier cell.

As described previously, a value of $\alpha_F$ obtainable through typical bipolar processes is in the range from 0.98 to 0.99, which is extremely near 1. Therefore, it is seen from the equation (46) that the multiplier core circuit of the seventh embodiment has the transfer characteristic approximately equal to that of the Gilbert multiplier cell.

Also, since this multiplier core circuit does not contain the transistors stacked as in the Gilbert cell, it can operate at a lower voltage than the Gilbert cell.

Figure 22:
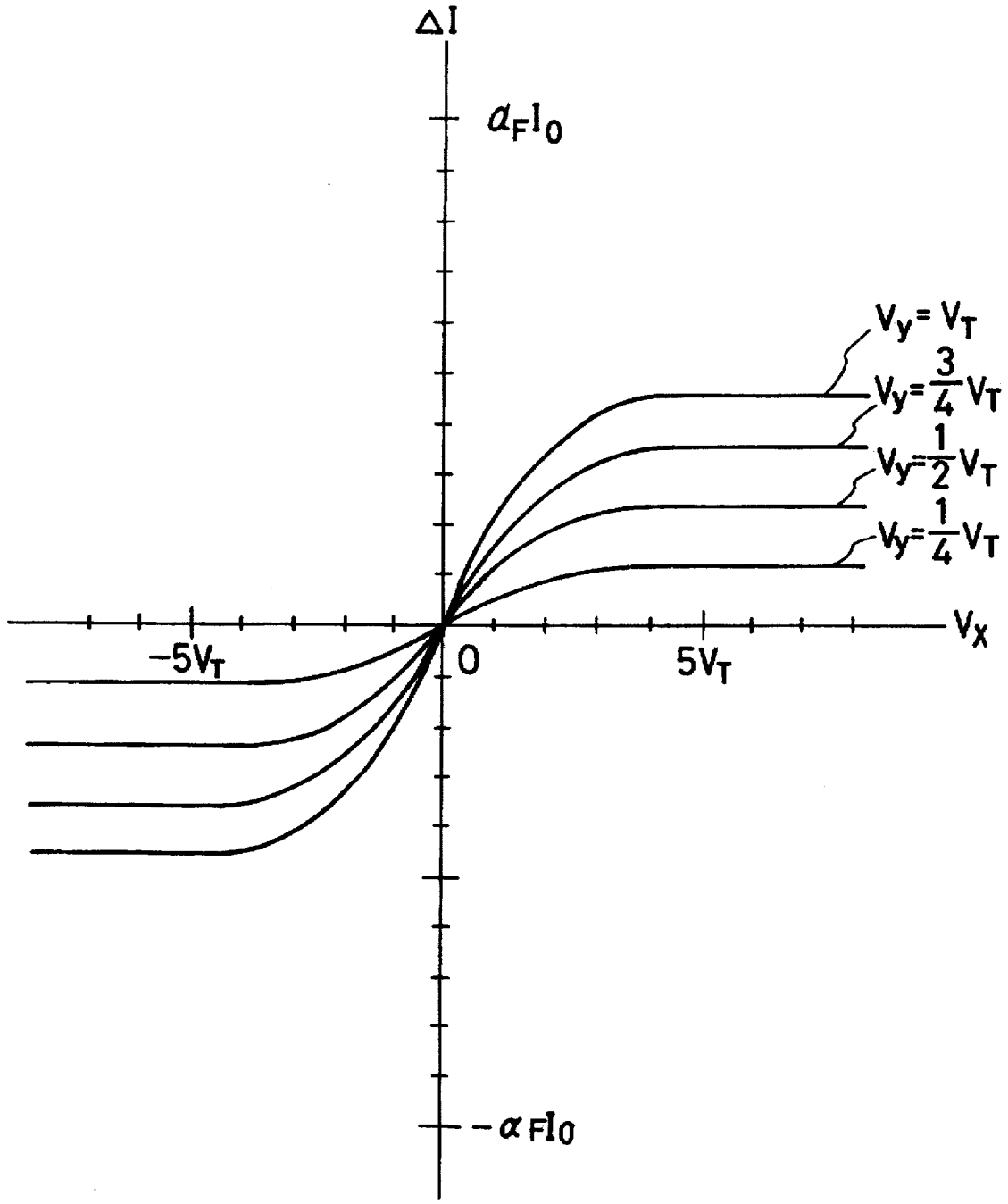
FIG. 22 shows the transfer characteristic of the multiplier core circuit of FIG. 21.
Figure 23:
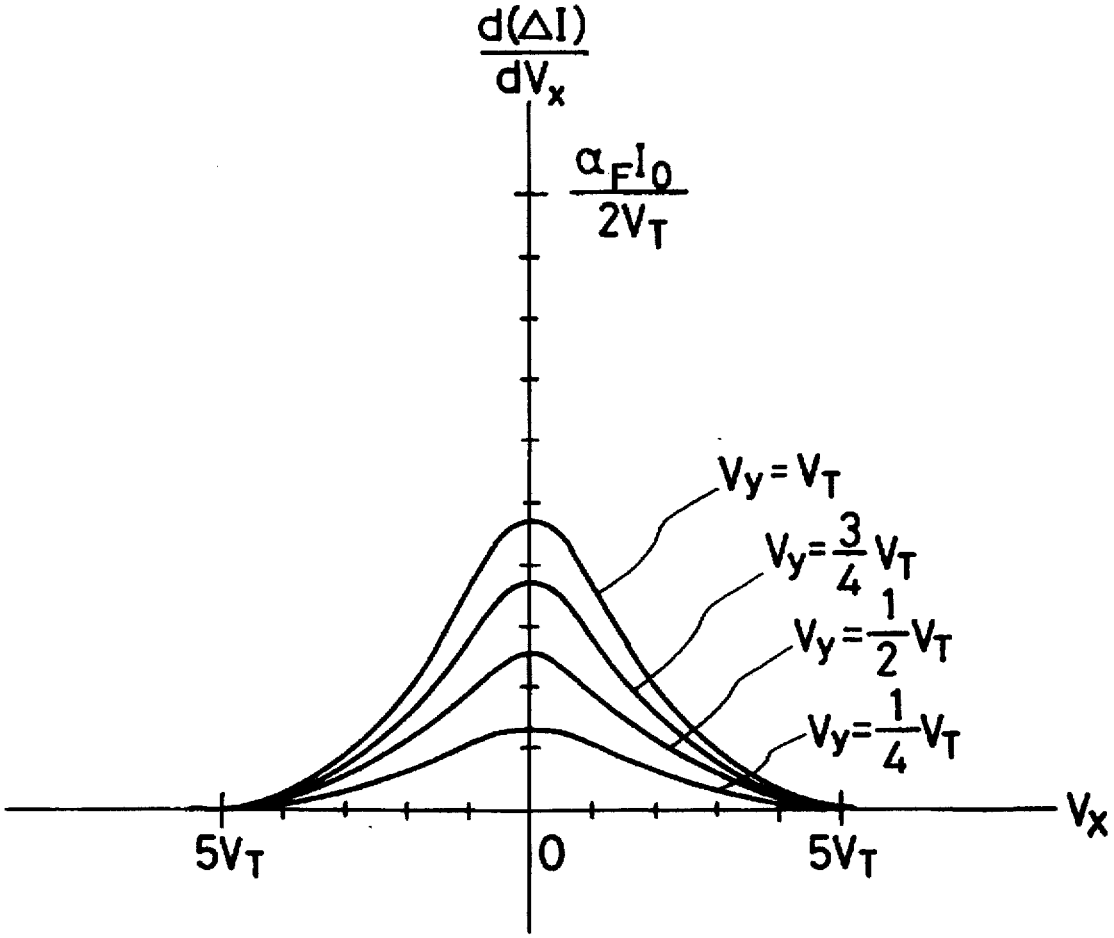
FIG. 23 shows the transconductance characteristic of the multiplier core circuit of FIG. 21.

FIGS. 22 and 23 show the transfer characteristic and the transconductance characteristic of the bipolar multiplier core circuit of the seventh embodiment, respectively.

Eight Embodiment

Figure 24:
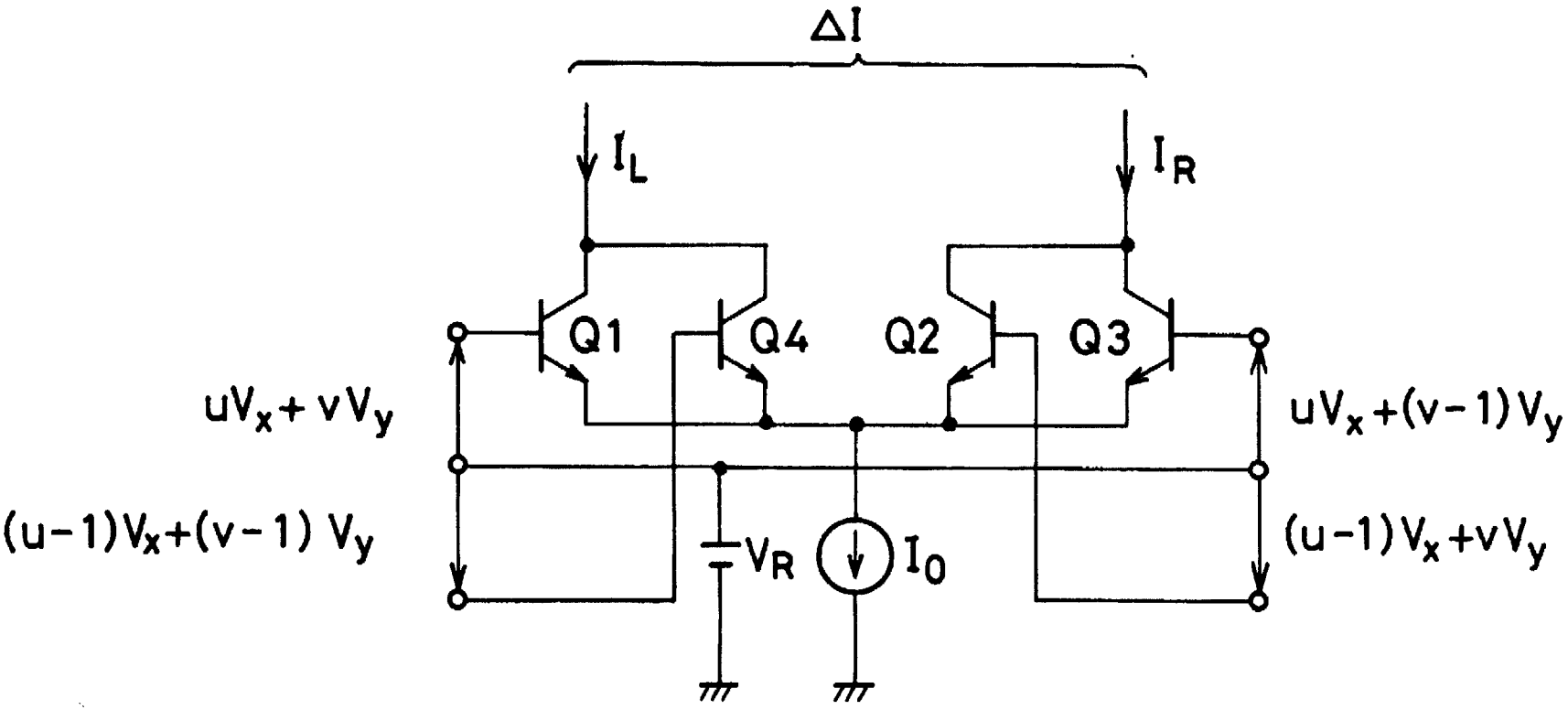
FIG. 24 is a circuit diagram showing a bipolar multiplier core circuit according to an eighth embodiment of the present invention, which contains a quadritail circuit.

FIG. 24 shows a four-quadrant multiplier core circuit according to an eighth embodiment of the present invention, which is composed of bipolar transistors.

The circuit of the eighth embodiment has the same configuration as that of the circuit of the seventh embodiment except for the input voltages, which is equivalent to a generalized one of the bipolar multiplier core circuit containing the quadritail circuit.

To achieve a multiplier characteristic by which the input voltages $V_x$ and $V_y$ are multiplied, the input voltages $V_1$, $V_2$, $V_3$ and $V_4$ to the respective bipolar transistors Q1, Q2, Q3 and Q4 can be expressed by the following generalized equations (47), (48), (49) and (50), where u and v are constants.

$$V_1=uV_x+vV_y \quad (47)$$

$$V_2=(u-1)V_x+vV_y \quad (48)$$

$$V_3=uV_x+(v-1)V_y \quad (49)$$

$$V_4=(u-1)V_x+(v-1)V_y \quad (50)$$

In this case, the above equation (17) becomes the following equation (51).

$$I_S\exp\left(\frac{V_R-V_E}{V_T}\right)=\frac{\alpha_F I_0}{\exp\left(\frac{uV_x+vV_y}{V_T}\right)\left\{1+\exp\left(-\frac{V_x+V_y}{V_T}\right)+\exp\left(-\frac{V_x}{V_T}\right)+\exp\left(-\frac{V_y}{V_T}\right)\right\}} \quad (51)$$

Therefore, the differential output current ΔI of this multiplier core circuit is given as the following equation (52).

$$\Delta I=\frac{\alpha_F I_0\exp\left(\frac{uV_x+vV_y}{V_T}\right)\left\{1+\exp\left(-\frac{V_x+V_y}{V_T}\right)-\exp\left(-\frac{V_x}{V_T}\right)-\exp\left(-\frac{V_y}{V_T}\right)\right\}}{\exp\left(\frac{uV_x+vV_y}{V_T}\right)\left\{1+\exp\left(-\frac{V_x+V_y}{V_T}\right)+\exp\left(-\frac{V_x}{V_T}\right)+\exp\left(-\frac{V_y}{V_T}\right)\right\}} \quad (52)$$

$$=\alpha_F I_0\tanh\left(\frac{V_x}{2V_T}\right)\tanh\left(\frac{V_y}{2V_T}\right)$$

The equation (52) is the same as the equation (19).

It is seen from the equation (52) that the core circuit of the eighth embodiment has the multiplier characteristic and that the constants u and v do not appear because they are cancelled.

Comparing the equations (47), (48), (49) and (50) in the eighth embodiment with the equations (30), (31), (32) and (33) in the second embodiment, it is seen that the input voltages $V_1$, $V_2$ $V_3$ and $V_4$ for the MOS multiplier core circuit are slightly different from those for the bipolar multiplier core circuit.

If w=1 in the equations (30), (31), (32) and (33), the same equations as those of (47), (48), (49) and (50) are obtained.

Ninth Embodiment

Figure 25:
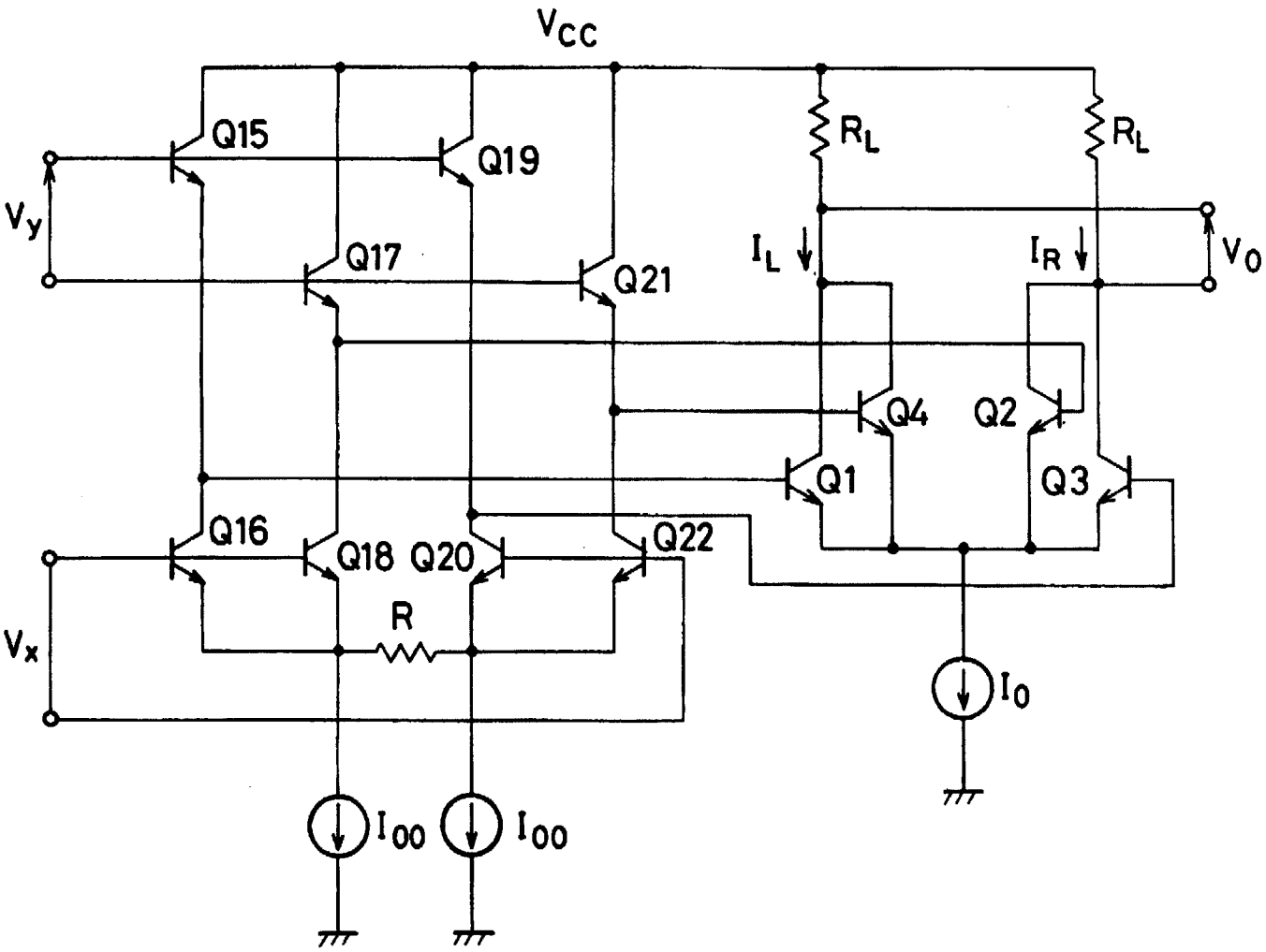
FIG. 25 is a circuit diagram showing a bipolar analog multiplier according to a ninth embodiment of the present invention, which contains the core circuit of FIG. 21.

FIG. 25 shows a four-quadrant analog multiplier according to a ninth embodiment of the present invention, which contains the multiplier core circuit of FIG. 21 of the seventh embodiment.

The analog multiplier of the ninth embodiment has the core circuit of the ninth embodiment, two load resistors (resistance: $R_L$) for the respective output currents $I_L$ and $I_R$ of the core circuit, and an input circuit through which the input voltages $V_x$ and $V_y$ are applied to the core circuit.

The input circuit contains a first cascode subcircuit formed of npn-type transistors Q15 and Q16 for the transistor Q1, a second cascode subcircuit formed of npn-type transistors Q17 and Q18 for the transistor Q2, a third cascode subcircuit formed of npn-type transistors Q19 and Q20 for the transistor Q3, and a fourth cascode subcircuit formed of npn-type transistors Q21 and Q22 for the transistor Q4.

The input circuit further contains a first constant current source (current: $I_{00}$) connected to the coupled emitters of the transistors Q16 and Q18, a second constant current source (current: $I_{00}$) connected to the coupled emitters of the transistors Q20 and Q22, and a resistor (resistance: R) connected to the coupled emitters of the transistors Q16 and Q18 and to the coupled emitters of the transistors Q20 and Q22.

In FIG. 25, if the value of the product $R\cdot I_{00}$ is sufficiently large compared with the input voltage range of the quadritail or core circuit, in other words, $R\cdot I_{00}>>2V_T$, it can consider that the base-emitter voltages of the transistors Q16, Q17, Q18 and Q19 are approximately equal to each other.

Therefore, in the same way as in the third embodiment of FIG. 15, a differential output voltage $V_0$ of the circuit of FIG. 25 has the multiplier characteristic.

Tenth Embodiment

Figure 26:
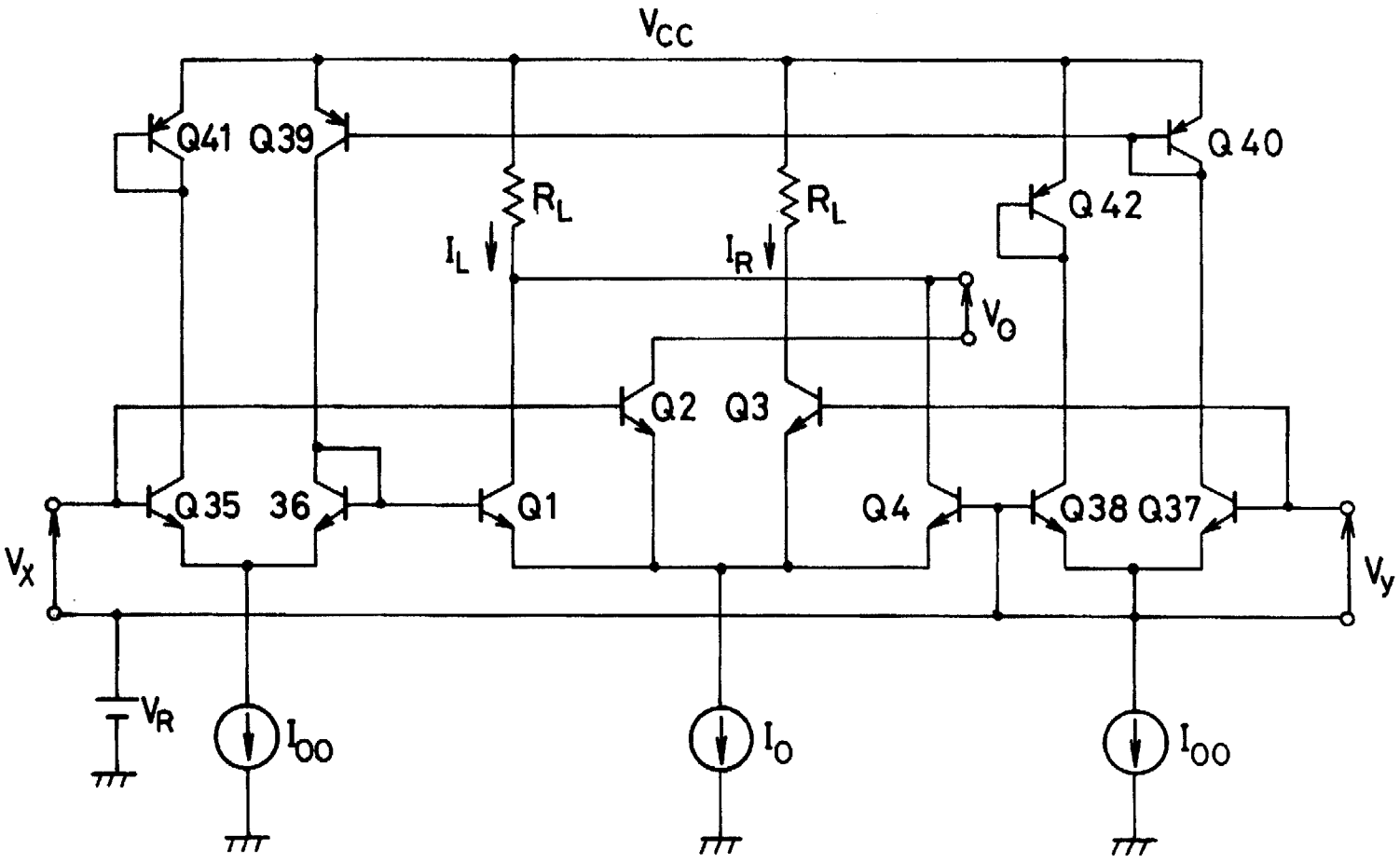
FIG. 26 is a circuit diagram showing a bipolar analog multiplier according to a tenth embodiment of the present invention, which contains a quadritail circuit.

FIG. 26 shows a four-quadrant analog multiplier according to a tenth embodiment of the present invention, which contains the multiplier core circuit of FIG. 21 of the seventh embodiment.

The analog multiplier of the tenth embodiment has the core circuit of the seventh embodiment formed of the bipolar transistors Q1, Q2, Q3 and Q4, an input circuit through which the input voltages $V_x$ and $V_y$ are applied to the core circuit, a voltage-source (voltage: $V_R$) connected to a reference point and the ground, two load resistors (resistance: $R_L$) as active loads of the respective first and second differential pairs, and a current mirror circuit formed of transistors Q39 and Q40.

The input circuit contains a first differential pair of source-coupled transistors Q35 and Q36 for the transistors Q1 and Q2, and a second differential pair of source-coupled transistors Q37 and Q38 for the transistors Q3 and Q4. The first differential pair is driven by a first constant current source (current: $I_{00}$) connected to the coupled emitters of the transistors Q1 and Q2. The second differential pair is driven by a second constant current source (current: $I_{00}$) connected to the coupled emitters of the transistors Q3 and Q4.

With the multiplier core circuit of this embodiment, since $\alpha_F$ is in the range from 0.98 to 0.99, which is not equal to 1, an error occurs due to $\alpha_F$. This error generates input offset voltages of the multiplier core circuit. However, the input offset voltages are sufficiently low and therefore, do not cause any problem for practical use.

Additionally, since the transistors Q41 and Q42 are provided for the first and second differential pairs, respectively, base-width modulation is effectively restrained in the respective differential pairs.

Eleventh Embodiment

Figure 27:
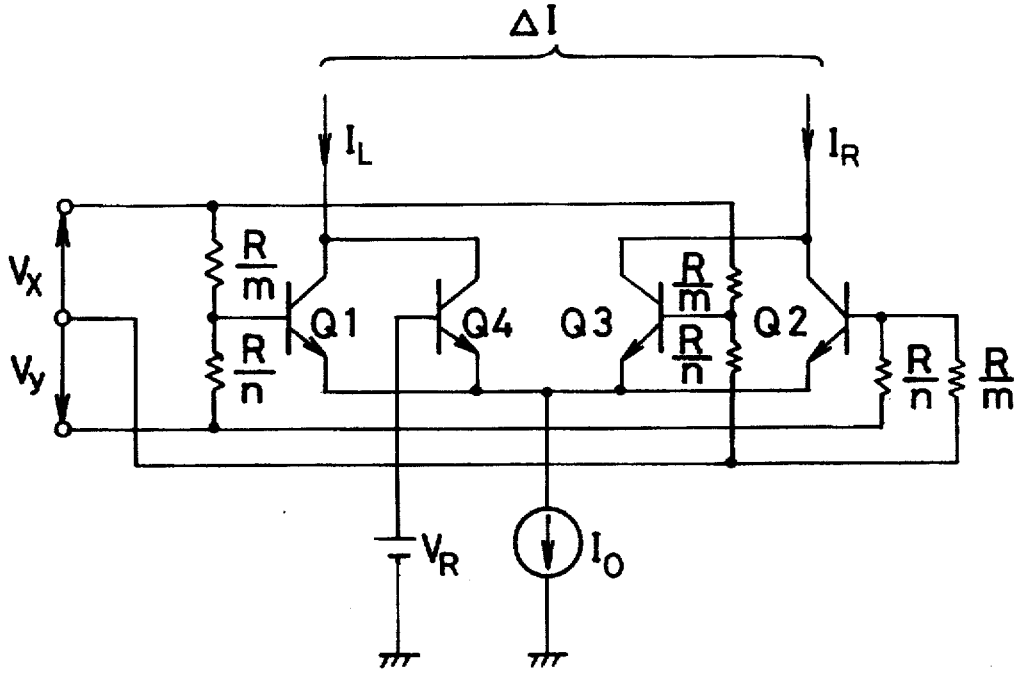
FIG. 27 is a circuit diagram showing a bipolar analog multiplier according to an eleventh embodiment of the present invention, which contains the divider circuit of FIG. 18.

FIG. 27 shows a four-quadrant analog multiplier according to an eleventh embodiment of the present invention, which contains the multiplier core circuit of FIG. 21 of the seventh embodiment and a voltage divider shown in FIG. 18.

In FIG. 27, since the input voltages $V_1$, $V_2$, $V_3$ and $V_4$ are expressed as the above equations (40), (41), (42) and (43), respectively, the differential output current ΔI of the eleventh embodiment is given by the following equation (53).

$$\Delta I = \alpha_F I_0 \tanh\left\{\frac{nV_x}{2(m+n)V_T}\right\}\tanh\left\{\frac{mV_y}{2(m+n)V_T}\right\} \quad (53)$$

It is seen from the equation (53) that the voltage $V_x$ is divided by [n/(m+n)] and the voltage $V_y$ is divided by [m/(m+n)]. This means that the core circuit of this embodiment has the input voltage ranges wider than those of the embodiment of FIG. 21, where $V_B=V_D$ in the equations (40), (41), (42) and (43) and therefore, the pair of the resistors through which the voltage $V_4$ is applied can be omitted.

Twelfth Embodiment

Figure 28:
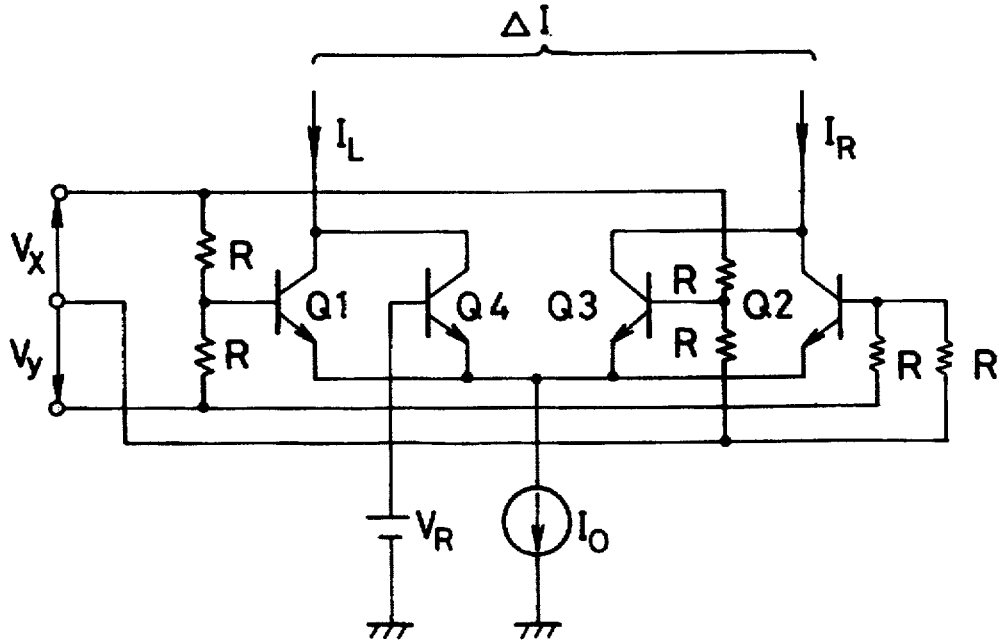
FIG. 28 is a circuit diagram showing a bipolar analog multiplier according to a twelfth embodiment of the present invention, which contains the divider circuit of FIG. 18.

FIG. 28 shows a four-quadrant analog multiplier according to a twelfth embodiment of the present invention, which contains the multiplier core circuit of FIG. 10 of the first embodiment and a voltage divider such as shown in FIG. 18. This circuit is equivalent to the circuit of FIG. 27 in which m=n.

The differential output current ΔI of the twelfth embodiment is given as the following equation (54), which is obtained by setting m=n in the equation (53).

$$\Delta I = \alpha_F I_0 \tanh\left(\frac{V_x}{4V_T}\right)\tanh\left(\frac{V_y}{4V_T}\right) \quad (54)$$

With the multiplier core circuit of the twelfth embodiment, since the input voltages are divided by two to be applied to the respective bases of the transistors Q1, Q2, Q3 and Q4, the input voltage range is enlarged to be twice as wide as that of the seventh embodiment of FIG. 21.

The dc voltage $V_R$ applied to the base of the transistor Q4 does not appear in the differential output current ΔI, even if the input impedance becomes a high specified value. As a result, the technique of inserting the resistors into the input circuit is effective for both voltage stabilization and current consumption reduction. Additionally, the circuit scale is minimized.

Figure 29:
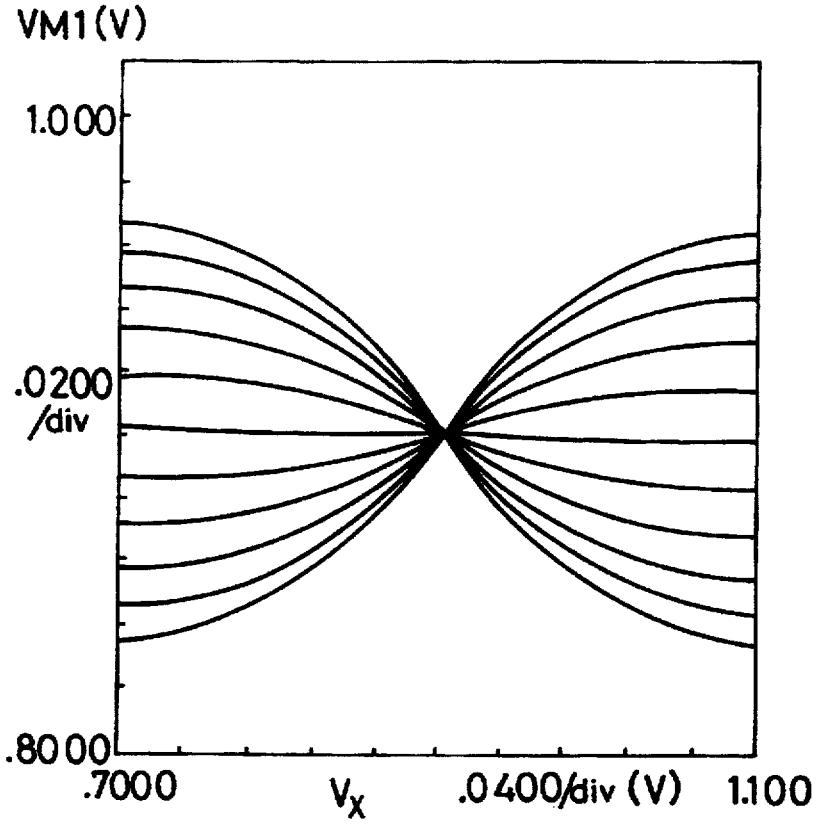
FIG. 29 shows the transfer characteristic of the analog multiplier of FIG. 28.

FIG. 29 shows the transfer characteristic of the multiplier core circuit of FIG. 28 with the voltage $V_y$ as a parameter. This characteristic was measured practically under the following conditions.

$I_0$=100 μA, $R_L$=2.2 k Ω, R=100 Ω, $V_R$=0.9V, $V_y$=0, ±20 mV, ±40 mV, ±60 mV, ±80 mV, and ±100 mV It is seen from FIG. 29 that the circuit of this embodiment can operate at a very low voltage of about one (1) volt with low current consumption.

In addition, when the coupled sources of the transistors Q1, Q2, Q3 and Q4 are grounded in the circuit of FIG. 21, the differential output current ΔI is expressed as the following equation (55).

$$\Delta I = 4I_0 \exp\left(\frac{V_x}{2V_T}\right)\exp\left(\frac{V_y}{2V_T}\right)\sinh\left(\frac{V_x}{2V_T}\right)\sinh\left(\frac{V_y}{2V_T}\right) \quad (55)$$

It is seen from the equation (55) that no multiplier characteristic is obtained in this case.

Thirteenth Embodiment

Figure 30:
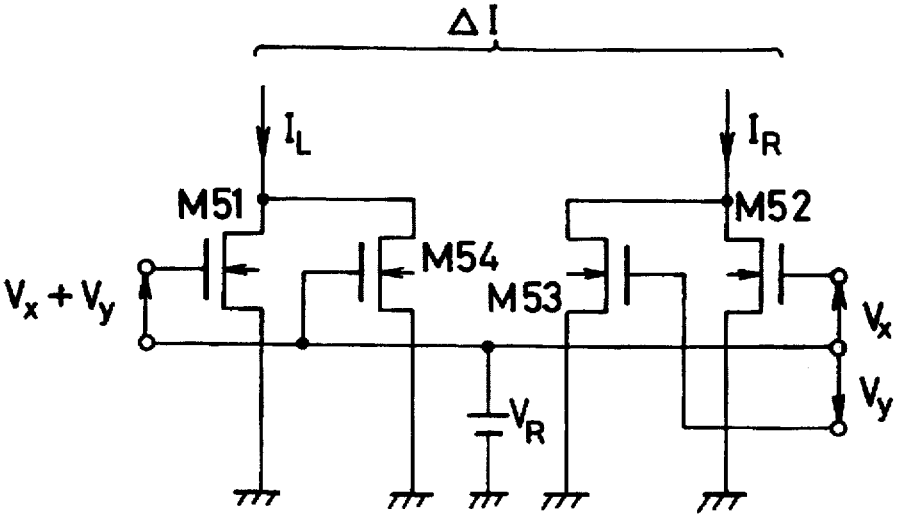
FIG. 30 is a circuit diagram showing a MOS multiplier core circuit according to a thirteenth embodiment of the present invention, which contains the grounded sources of the MOSFETs.

FIG. 30 shows a four-quadrant MOS multiplier core circuit according to a thirteenth embodiment of the present invention. This circuit is equivalent to a circuit obtained by grounding the sources of the MOSFETs M1, M2, M3 and M4 and removing the constant current source in the multiplier core circuit of FIG. 10 of the first embodiment.

Drain currents $I_{D51}$, $I_{D52}$, $I_{D53}$ and $I_{D54}$ of the MOSFETs M51, M52, M53 and M54 are expressed as the following equations (56), (57), (58) and (59), respectively.

$$I_{D1}=\beta(V_x+V_y+V_R-V_{TH})^2 \quad (56)$$

$$I_{D2}=\beta(V_x+V_R-V_{TH})^2 \quad (57)$$

$$I_{D3}=\beta(V_y+V_R-V_{TH})^2 \quad (58)$$

$$I_{D4}=\beta(V_R-V_{TH})^2 \quad (59)$$

The differential output current ΔI is given by the following equations (60a), (60b), (60c), (60d), (60e), (60f) and (60g).

$$\begin{aligned}\Delta I &= I_L - I_R = (I_{D1}+I_{D4})-(I_{D2}+I_{D3}) \quad (60a)\\ &= 2\beta V_x V_y\\ &(M1,M2,M3,M4\text{: saturation})\end{aligned}$$

$$\begin{aligned}\Delta I &= I_L - I_R = (I_{D1}+I_{D4})-(I_{D2}+I_{D3}) \quad (60b)\\ &= 2\beta V_x V_y - \beta(V_y+V_y+V_R-V_{TH})^2\\ &(M1\text{: cutoff})\end{aligned}$$

$$\begin{aligned}\Delta I &= I_L - I_R = (I_{D1}+I_{D4})-(I_{D2}+I_{D3}) \quad (60c)\\ &= 2\beta V_x V_y - \beta(V_x+V_R-V_{TH})^2\\ &(M2\text{: cutoff})\end{aligned}$$

$$\begin{aligned}\Delta I &= I_L - I_R = (I_{D1}+I_{D4})-(I_{D2}+I_{D3}) \quad (60d)\\ &= 2\beta V_x V_y - \beta(V_x+V_R-V_{TH})^2\\ &(M3\text{: cutoff})\end{aligned}$$

$$\begin{aligned}\Delta I &= I_L - I_R = (I_{D1}+I_{D4})-(I_{D2}+I_{D3}) \quad (60e)\\ &= -\beta\{V_y^2+2V_y(V_R-V_{TH})\}\\ &(M1,M2\text{: cutoff})\end{aligned}$$

$$\begin{aligned}\Delta I &= I_L - I_R = (I_{D1}+I_{D4})-(I_{D2}+I_{D3}) \quad (60f)\\ &= -\beta\{V_x^2+2V_x(V_R-V_{TH})\}\\ &(M1,M3\text{: cutoff})\end{aligned}$$

$$\begin{aligned}\Delta I &= I_L - I_R = (I_{D1}+I_{D4})-(I_{D2}+I_{D3}) \quad (60g)\\ &= \beta(V_R-V_{TH})^2\\ &(M1,M2,M3\text{: cutoff})\end{aligned}$$

It is seen from the equations (60a), (60b), (60c), (60d), (60e), (60f) and (60g) that the cutoff conditions of the transistors are different from each other in each quadrant of the $V_x$ and $V_y$ plane.

In the first quadrant where $V_x \geqq 0$, $V_y \geqq 0$, none of the MOSFETs M1, M2, M3 and M4 are cut off. However, the dc voltage $V_R$ may be adjusted and the input voltages to the respective transistors may be set so that none of the MOSFETs M1, M2, M3 and-M4 are cut off.

Figure 31:
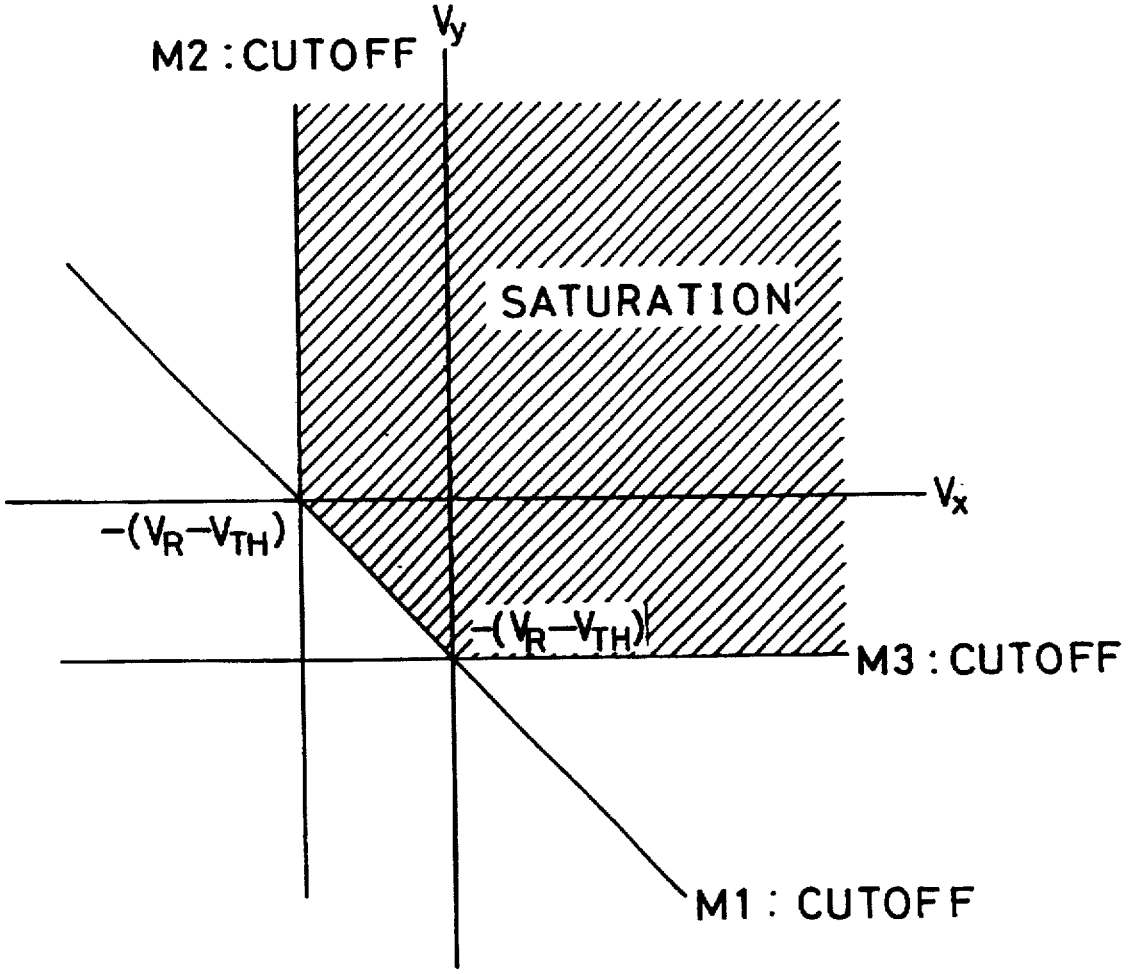
FIG. 31 shows the relationship between the input voltage ranges of $V_x$ and $V_y$ and the operating situations of the MOSFETs according to the multiplier core circuit of FIG. 10.

Therefore, it is seen from the equations (60a), (60b), (60c), (60d), (60e), (60f) and (60g) that the cutoff phenomenon of the MOSFETs M1, M2, M3 and M4 can be prevented if the input voltage ranges are set to satisfy $$|V_x|+|V_y| \leqq V_R - V_{TH},$$

as shown in FIG. 31.

Figure 4:
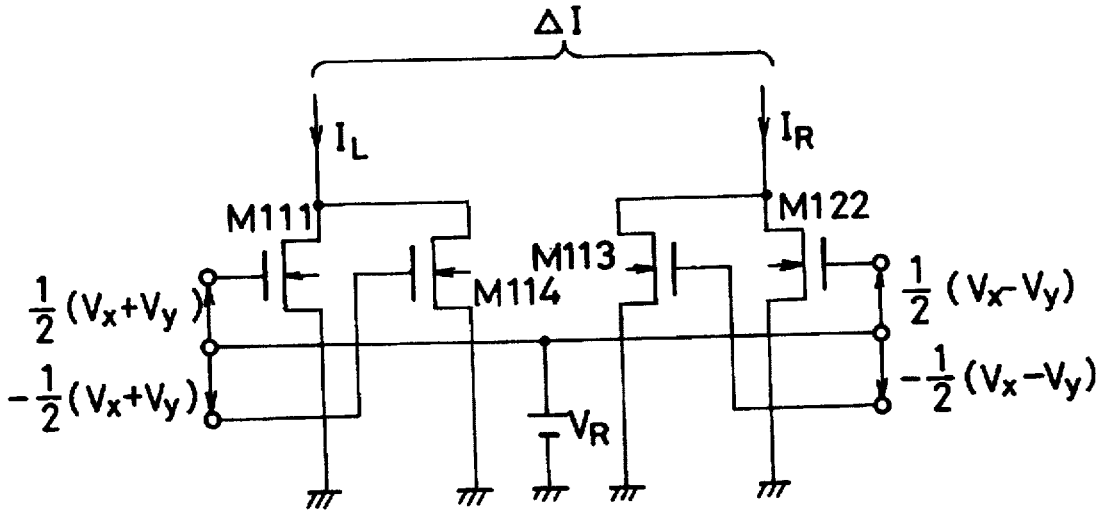
FIG. 4 PRIOR ART
FIG. 4 is a circuit diagram showing a fourth example of the conventional MOS multiplier core circuit which was disclosed by Bult and Wallinga.

The equation (60a) is the same as the equations (18) and (19) of the conventional multiplier core circuits of FIGS. 4 and 6. Therefore, the circuit of the thirteenth embodiment has an ideal multiplier characteristic within the range where none of the MOSFETs M1, M2, M3 and M4 are cut off.

Differentiating the equation (60a) by $V_x$ provides the transconductance characteristic, as shown in the following equation (61).

$$\frac{d(\Delta I)}{dV_x} = 2\beta V_y \quad (61)$$

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A multiplier core circuit comprising:

a quadritail circuit formed of first, second, third and fourth transistors whose emitters or sources are coupled together;

collectors or drains of said first and fourth transistors being coupled together;

collectors or drains of said second and third transistors being coupled together;

said quadritail circuit being driven by a tail current through said coupled emitters or sources;

a sum of a first input signal and a second input signal to be multiplied being applied to a base or gate of said first transistor with regard to a reference point;

said first input signal being applied to a base or gate of said second transistor with regard to said reference point; and said second input signal being applied to a base or gate of said third transistor with regard to said reference point;

neither said first input signal nor said second input signal being applied to a base or gate of said fourth transistor;

wherein an output signal showing a result of multiplication of said first and second input signals is differentially derived between said collectors or drains of said first and fourth transistors and said collectors or drains of said second and third transistors.

2. The multiplier core circuit as claimed in claim 1, wherein said first, second, third and fourth transistors are FETs.

3. The multiplier core circuit as claimed in claim 2, wherein said first, second, third and fourth transistors are MOSFETs.

4. The multiplier core circuit as claimed in claim 1, wherein said first, second, third and fourth transistors are bipolar transistors.

5. The multiplier core circuit as claimed in claim 1, further comprising a constant current source or sink connected to said coupled emitters or sources of said first, second, third and fourth transistors, wherein said constant current source or sink produces said tail current.

6. The multiplier core circuit as claimed in claim 1, further comprising a constant voltage source connected to said reference point, wherein said base or gate of said fourth transistor is connected to said reference point.

7. An analog multiplier comprising the multiplier core circuit of claim 1.

8. The analog multiplier as claimed in claim 7, further comprising an input circuit through which said first input signal and said second input signal are applied to said quadritail circuit;

wherein said input circuit contains a first cascode subcircuit formed of fifth and sixth transistors for said first transistor, a second cascode subcircuit formed of seventh and eighth transistors for said second transistor, a third cascode subcircuit formed of ninth and tenth transistors for said third transistor, and a fourth cascode subcircuit formed of eleventh and twelfth transistors for said fourth transistor.

9. The analog multiplier as claimed in claim 7, further comprising an input circuit through which said first input signal and said second input signal are applied to said quadritail circuit;

wherein said input circuit contains a third differential pair of fifth and sixth transistors for said first and second transistors, and a fourth differential pair of seventh and eighth transistors for said third and fourth transistors.

10. The analog multiplier as claimed in claim 9, said sum of said first input signal and said second input signal is produced by said third differential pair of said input circuit.

11. The analog multiplier as claimed in claim 7, further comprising a first divider formed of first and second resistors for said first transistor, a second divider formed of third and fourth resistors for said second transistor, and a third divider formed of fifth and sixth resistors for said third transistor;

wherein said sum of said first input signal and said second input signal is applied to said base or gate of said first transistor through said first divider;

said first input signal is applied to said base or gate of said second transistor through said second divider; and said second input signal is applied to said base or gate of said third transistor through said third divider.

12. The analog multiplier as claimed in claim 11, said first resistor and said second resistor are equal in resistance to each other, said third resistor and said fourth resistor are equal in resistance to each other, and said fifth resistor and said sixth resistor are equal in resistance to each other.

13. The analog multiplier as claimed in claim 11, said first resistor and said second resistor are different in resistance from each other, said third resistor and said fourth resistor are different in resistance from each other, and said fifth resistor and said sixth resistor are different in resistance from each other.

14. A multiplier core circuit comprising:

first, second, third and fourth FETs whose sources are grounded;

drains of said first and fourth FETs being coupled together;

drains of said second and third FETs being coupled together;

a sum of a first input signal and a second input signal to be multiplied being applied to a gate of said first FET with regard to a reference point;

said first input signal being applied to a gate of said second FET with regard to said reference point; and said second input signal being applied to a gate of said third FET with regard to said reference point;

neither said first input signal nor said second input signal being applied to a gate of said fourth FET;

wherein an output signal showing a result of multiplication of said first and second input signals is differentially derived between said drains of said first and fourth FETs and said drains of said second and third FETs.

15. The multiplier core circuit as claimed in claim 14, further comprising a constant voltage source connected to said reference point, wherein said gate of said fourth FET is connected to said reference point.

16. An analog multiplier comprising the multiplier core circuit of claim 14.

17. A multiplier core circuit comprising:

a quadritail circuit formed of first, second, third and fourth FETs whose sources are coupled together;

drains of said first and fourth FETs being coupled together;

drains of said second and third FETs being coupled together;

said quadritail circuit being driven by a tail current through said coupled sources; and said gate of said first FET for receiving $(uV_x+vV_y)$, said gate of said second FET for receiving $\{(u-w)V_x+vV_y\}$, said gate of said third FET $\{uV_x+(v-1/w)V_y\}$, and said gate of said fourth FET for receiving $\{(u-w)V_x+(v-1/w)V_y\}$, where $V_x$ and $V_y$ are first and second input signals, respectively and u, v and w are constants, excluding the combination u=v=½, w=1;

wherein an output signal showing a result of multiplication of said first and second input signals is differentially derived between said collectors or drains of said first and fourth transistors and said collectors or drains of said second and third transistors.

18. The multiplier core circuit as claimed in claim 17, further comprising a constant voltage source to which said base or gate of said fourth transistor is connected.

19. An analog multiplier comprising the multiplier core circuit of claim 17.

20. The analog multiplier as claimed in claim 19, further comprising an input circuit through which said first input signal and said second input signal are applied to said quadritail circuit;

wherein said input circuit contains a first cascode subcircuit formed of fifth and sixth transistors for said first FET, a second cascode subcircuit formed of seventh and eighth transistors for said second FET, a third cascode subcircuit formed of ninth and tenth transistors for said third FET, and a fourth cascode subcircuit formed of eleventh and twelfth transistors for said fourth FET.

21. The analog multiplier as claimed in claim 19, further comprising an input circuit through which said first input signal and said second input signal are applied to said quadritail circuit;

wherein said input circuit contains a third differential pair of fifth and sixth FETs, for said first and second FET, and a fourth differential pair of seventh and eighth transistors for said third and fourth transistors.

22. The analog multiplier as claimed in claim 21, said sum of said first input signal and said second input signal is produced by said third differential pair of said input circuit.

23. The analog multiplier as claimed in claim 19, further comprising a first divider formed of first and second resistors for said first FET, a second divider formed of third and fourth resistors for said second FET, and a third divider formed of fifth and sixth resistors for said third FET;

wherein said sum of said first input signal and said second input signal is applied to said gate of said first FET through said first divider;

said first input signal is applied to said gate of said second FET through said second divider; and said second input signal is applied to said gate of said third FET through said third divider.

24. The analog multiplier as claimed in claim 23, said first resistor and said second resistor are equal in resistance to each other, said third resistor and said fourth resistor are equal in resistance to each other, and said fifth resistor and said sixth resistor are equal in resistance to each other.

25. The analog multiplier as claimed in claim 23, said first resistor and said second resistor are different in resistance from each other, said third resistor and said fourth resistor are different in resistance from each other, and said fifth resistor and said sixth resistor are different in resistance from each other.

26. The multiplier core circuit as claimed in claim 17, wherein said coupled sources or emitters of said first, second, third and fourth transistors are grounded.

27. The multiplier core circuit as claimed in claim 17, wherein said coupled sources or emitters of said first, second, third and fourth transistors are connected to a tail current.

28. A multiplier core circuit comprising:

a quadritail circuit formed of first, second, third and fourth bipolar transistors whose emitters are coupled together;

collectors of said first and fourth bipolar transistors being coupled together;

emitters of said second and third bipolar transistors being coupled together;

said quadritail circuit being driven by a tail current through said coupled emitters; and said base of said first bipolar transistor for receiving $(uV_x+vV_y)$, said base of said second bipolar transistor for receiving $\{(u-1)V_x+vV_y\}$, said base of said third bipolar transistor for receiving $\{uV_x+(v-1)V_y\}$, and said base of said fourth bipolar transistor for receiving $\{(u-1)V_x+(v-1)V_y\}$, where $V_x$ and $V_y$ are first and second input signals, respectively and u, v and w are constants, excluding the combination u=v=w=½;

wherein an output signal showing a result of multiplication of said first and second input signals is differentially derived between said collectors of said first and fourth bipolar transistors and said collectors of said second and third bipolar transistors.

29. The multiplier core circuit as claimed in claim 28, further comprising a constant voltage source to which said base or gate of said fourth transistor is connected.

30. An analog multiplier comprising the multiplier core circuit of claim 28.

31. The analog multiplier as claimed in claim 30, further comprising an input circuit through which said first input signal and said second input signal are applied to said quadritail circuit;

wherein said input circuit contains a first cascode subcircuit formed of fifth and sixth transistors for said first transistor, a second cascode subcircuit formed of seventh and eighth transistors for said second transistor, a third cascode subcircuit formed of ninth and tenth transistors for said third transistor, and a fourth cascode subcircuit formed of eleventh and twelfth transistors for said fourth transistor.

32. The analog multiplier as claimed in claim 30, further comprising an input circuit through which said first input signal and said second input signal are applied to said quadritail circuit;

wherein said input circuit contains a third differential pair of fifth and sixth transistors for said first and second transistors, and a fourth differential pair of seventh and eighth transistors for said third and fourth transistors.

33. The analog multiplier as claimed in claim 32, said sum of said first input signal and said second input signal is produced by said third differential pair of said input circuit.

34. The analog multiplier as claimed in claim 30, further comprising a first divider formed of first and second resistors for said first transistor, a second divider formed of third and fourth resistors for said second transistor, and a third divider formed of fifth and sixth resistors for said third transistor;

wherein said sum of said first input signal and said second input signal is applied to said base or gate of said first transistor through said first divider;

said first input signal is applied to said base or gate of said second transistor through said second divider; and said second input signal is applied to said base or gate of said third transistor through said third divider.

35. The analog multiplier as claimed in claim 34, said first resistor and said second resistor are equal in resistance to each other, said third resistor and said fourth resistor are equal in resistance to each other, and said fifth resistor and said sixth resistor are equal in resistance to each other.

36. The analog multiplier as claimed in claim 34, said first resistor and said second resistor are different in resistance from each other, said third resistor and said fourth resistor are different in resistance from each other, and said fifth resistor and said sixth resistor are different in resistance from each other.

37. A multiplier core circuit comprising:

a circuit formed of first, second, third and fourth transistors whose sources or emitters are coupled together;

drains or collectors of said first and fourth transistors being coupled together;

drains or collectors of said second and third transistors being coupled together; and said gate or base of said first transistor for receiving $(uV_x+vV_y)$, said gate or base of said second transistor for receiving $\{(u-w)V_x+vV_y\}$, said gate or base of said third transistor for receiving $\{uV_x+(v-1/w)V_y\}$, and said gate or base of said fourth transistor for receiving $\{(u-w)V_x+(v-1/w)V_y\}$, where $V_x$ and $V_y$ are first and second input signals, respectively and u, v and w are constants, excluding the combination u=v=½;

wherein an output signal showing a result of multiplication of said first and second input signals is differentially derived between said collectors or drains of said first and fourth transistors and said collectors or drains of said second and third transistors.

38. An analog multiplier comprising the multiplier core circuit of claim 37.

39. The analog multiplier as claimed in claim 38, further comprising an input circuit through which said first input signal and said second input signal are applied to said circuit;

wherein said input circuit contains a first cascode subcircuit formed of fifth and sixth transistors for said first transistor, a second cascode subcircuit formed of seventh and eighth transistors for said second transistor, a third cascode subcircuit formed of ninth and tenth transistors for said third transistor, and a fourth cascode subcircuit formed of eleventh and twelfth transistors for said fourth transistor.

* * * * *